US010392711B2

(12) United States Patent
Alkhaldi et al.

(10) Patent No.: US 10,392,711 B2
(45) Date of Patent: Aug. 27, 2019

(54) METHOD FOR INHIBITING CORROSION OF STEEL WITH LEAF EXTRACTS

(71) Applicant: Imam Abdulrahman Bin Faisal University, Dammam (SA)

(72) Inventors: Mashael Abdulaziz Alkhaldi, Dammam (SA); Khadeeja Al-Qahtani, Dammam (SA)

(73) Assignee: Imam Abdulrahman Bin Faisal University, Damman (SA)

( * ) Notice: Subject to any disclaimer, the term of this patent is extended or adjusted under 35 U.S.C. 154(b) by 205 days.

(21) Appl. No.: 15/492,403

(22) Filed: Apr. 20, 2017

(65) Prior Publication Data

US 2018/0305825 A1 Oct. 25, 2018

(51) Int. Cl.
*C23F 11/04* (2006.01)
*C23G 1/08* (2006.01)

(52) U.S. Cl.
CPC ..... *C23F 11/04* (2013.01); *C23G 1/088* (2013.01)

(58) Field of Classification Search
None
See application file for complete search history.

(56) References Cited

U.S. PATENT DOCUMENTS 5,470,504 A * 11/1995 Kiehn ..... C08L 83/04 508/214
5,653,917 A * 8/1997 Singerman ..... C02F 5/10 134/3
8,926,867 B2 1/2015 Gomes et al.
2011/0266502 A1* 11/2011 Gomes ..... C23F 11/10 252/393

FOREIGN PATENT DOCUMENTS

IN 482/MUM/2008 10/2009

OTHER PUBLICATIONS

Challouf et al.; Extracts as Mild Steel Corrosion Green Inhibitors in Aqueous Chloride Medium; Journal of Environmental Protection; vol. 7, 2016; pp. 532-544; Jan. 2016.*
Hassan et al.; Citrus Aurantium Leaves Extracts as Sustainable Corrosion Inhibitor of Mild Steel in Sulfuric Acid; South African Journal of Chemical Engineering 22 (2016) 1-5.*
Arash Fattah-Alhosseini, et al., "Corrosion inhibition of SAE 1018 carbon steel in $H_2S$ and HCI solutions by lemon verbena leaves extract", Measurement, vol. 94, 2016, pp. 787-793.
(Continued)

*Primary Examiner* — Michael P. Rodriguez
(74) *Attorney, Agent, or Firm* — Oblon, McClelland, Maier & Neustadt, L.L.P.

(57) ABSTRACT

A method for inhibiting corrosion on a steel surface by treatment with a solution comprising a citrus leaf extract and a leaf extract from a second plant is described. The citrus leaf extract may be from a *Citrus x limon* (lemon) plant, and the second leaf extract may be from a saffron plant, an almond plant, a *Psidium guajava* plant, or an *Origanum majorana* plant. Methods of making and applying the leaf extracts to steel are discussed, as well as the electrochemical properties and corrosion inhibition of treated steel in the presence of a corrosive agent.

20 Claims, 13 Drawing Sheets

(56) References Cited

OTHER PUBLICATIONS

Karim H. Hassan, et al., "Citrus *aurantium* leaves extracts as a sustainable corrosion inhibitor of mild steel in sulfuric acid", South African Journal of Chemical Engineering, vol. 22, 2016, pp. 1-5.
Hassen Challouf, et al., "*Origanum majorana* Extracts as Mild Steel Corrosion Green Inhibitors in Aqueous Chloride Medium", Journal of Environmental Protection, vol. 7, 2016, pp. 532-544.
A. Y. El-Etre, "Inhibition of acid corrosion of carbon steel using aqueous extract of olive leaves", Journal of Colloid and Interface Science, vol. 314, 2007, pp. 578-583.

* cited by examiner

METHOD FOR INHIBITING CORROSION OF STEEL WITH LEAF EXTRACTS

STATEMENT OF ACKNOWLEDGEMENT

This project was prepared with financial support by the Deanship of Scientific Research in Imam AbdulRahman Bin Faisal University, Saudi Arabia, under Grant No. [2014084].

BACKGROUND OF THE INVENTION

Technical Field

The present invention relates to a method of using a citrus leaf extract with a second leaf extract to inhibit corrosion of a steel surface.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Throughout the world acid solutions are commonly used for the removal of undesirable scale and rust in industrial processes. For example, hydrochloric acid is widely used in the pickling of steel and ferrous alloys. The use of inhibitors is one of the most practical methods to protect against corrosion and prevent metal dissolution. Over the years, many studies have been carried out to find suitable compounds which can be used as corrosion inhibitors for metals in different aqueous solutions. These studies have revealed that organic compounds, especially those with nitrogen, sulfur, and oxygen, show significant inhibition efficiency in acidic solutions. See M. M. El-Naggar, *Corros. Sci.,* 49, 2226 (2007); K. O. Orubite et al., *Mater. Lett.,* 58, 1768 (2004); G. Gunasekaran et al., *Electrochim. Acta,* 49, 4387 (2004); A. Y. El-Etre, et al., *Corros. Sci.,* 47, 385 (2005); Y. Li, et al., *Appl. Surf. Sci.,* 252, 1245 (2005); P. B. Raja et al., *Mater. Lett.,* 62, 113 (2008); A. M. Abdel-Gaber, et al., *Corros. Sci.,* 51, 1038 (2009); M. A. Quraishi, et al., *Mater. Chem. Phys.,* 122, 114 (2010); O. K. Abiola et al., *Corros. Sci.,* 52, 661 (2010); M. A. Ameer, *Mater. Chem. Phys.,* 122, 321 (2010); V. V. Torres, et al., *Corros. Sci.,* 53, 2385 (2011); and S. Deng et al., *Corros. Sci.,* 55, 407 (2012), each incorporated herein by reference in its entirety. Plant extracts have become an important environmentally acceptable, cheap, and readily available source of a wide range of inhibitors, and they are rich sources of ingredients that have high inhibition efficiencies.

In view of the foregoing, one objective of the present invention is to provide a method of inhibiting the corrosion of steel by contacting the steel with a solution comprising a citrus leaf extract and a leaf extract of a saffron plant, an almond plant, a guava plant (*Psidium guajava*), or an *Origanum majorana* plant.

BRIEF SUMMARY OF THE INVENTION

According to a first aspect, the present disclosure relates to a method of inhibiting corrosion of steel. The method comprises contacting a surface of the steel with a solution comprising 20-300 ppm of a citrus leaf extract and 20-450 ppm of a second leaf extract to form a treated steel.

In one embodiment of the method, the citrus leaf extract is an aqueous extract from the leaf of a *Citrus x limon* plant.

In one embodiment of the method, the second leaf extract is an aqueous leaf extract from a saffron plant, an almond plant, a *Psidium guajava* plant, and/or an *Origanum majorana* plant.

In a further embodiment, the solution comprises 50-100 ppm of the citrus leaf extract and 300-450 ppm of the aqueous leaf extract from an *Origanum majorana* plant.

In one embodiment of the method, the solution further comprises a carrier agent or a stabilizing agent.

In a further embodiment, where the solution has a carrier agent, the carrier agent is methanol, ethanol, isopropanol, ethylene glycol, propylene glycol, dimethylformamide, dimethyl sulfoxide, N-methyl pyrrolidone, propylene glycol methyl ether, 2-butoxyethanol, and/or a hydrofluoroalkane.

In a further embodiment, where the solution has a stabilizing agent, the stabilizing agent is acetic acid, a citrate buffer, a borate buffer, a phosphate buffer, benzalkonium chloride, butylated hydroxytoluene, butylated hydroxyanisole, EDTA, and/or EGTA.

In one embodiment of the method, the citrus leaf extract is made by heating a *citrus* leaf in water with a mass ratio of the *citrus* leaf to water of 0.01:1-1:1, and the second leaf extract is made by heating a second leaf in water with a mass ratio of the second leaf to water of 0.01:1-1:1.

In a further embodiment, the citrus leaf and the second leaf are heated in water at 50-125° C. for 0.25-48 h.

In a further embodiment, the citrus leaf, the second leaf, or both are crushed, blended, or cut.

In one embodiment of the method, the solution is formed by reconstituting a dried citrus leaf extract, a dried second leaf extract, or both in water.

In one embodiment of the method, the citrus leaf extract, the second leaf extract, or both is adsorbed onto a 0.90-0.97 surface area fraction of the steel.

In one embodiment of the method, a corrosion of the treated steel in the presence of a corrosive agent is inhibited 85-100% more than a piece of steel contacted with the citrus leaf extract and no second leaf extract in the presence of the corrosive agent.

In a further embodiment, the corrosive agent is an aqueous solution comprising a salt or an inorganic acid.

In a further embodiment, where the corrosive agent is present as an aqueous solution comprising an inorganic acid, the inorganic acid is nitric acid, hydrochloric acid, hydrofluoric acid, sulfuric acid, and/or perchloric acid.

In a further embodiment, where the corrosive agent is present as an aqueous solution comprising a salt, the salt is a chloride salt, a carbonate salt, a bicarbonate salt, and/or a sulfate salt.

In one embodiment of the method, the steel comprises 0.05-1.0 wt % carbon relative to a total weight of the steel.

In one embodiment of the method, the contacting is done by spraying, submerging, painting, or spin coating.

In one embodiment of the method, the treated steel is an electrode with a corrosion current density of 0.001-0.05 $mA/cm^2$ in the presence of 0.1-1 M inorganic acid at 20-30° C.

According to a second aspect, the present disclosure relates to a method of cleaning steel. This involves the step of contacting a surface of a steel with a solution comprising 20-300 ppm of an aqueous extract from the leaf of a *Citrus x limon* plant to form a cleaned steel.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
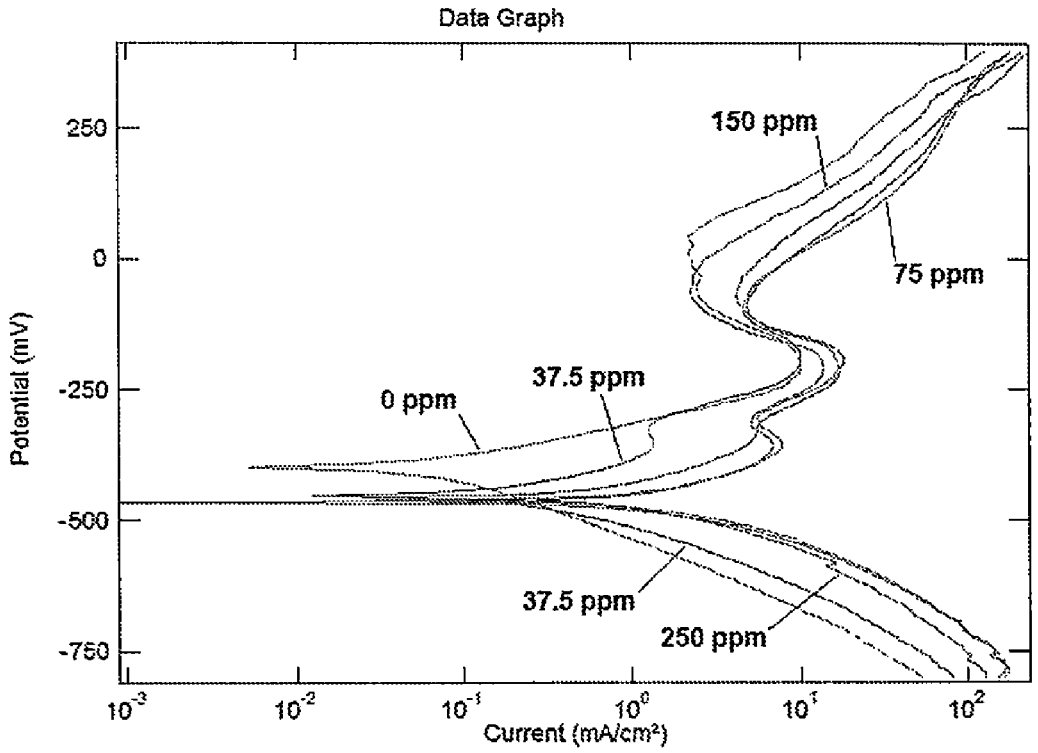
FIG. 1 shows potentiodynamic polarization curves for steel at different concentrations of lemon leaves extracts in 0.5 M HCl at 25° C.
Figure 2:
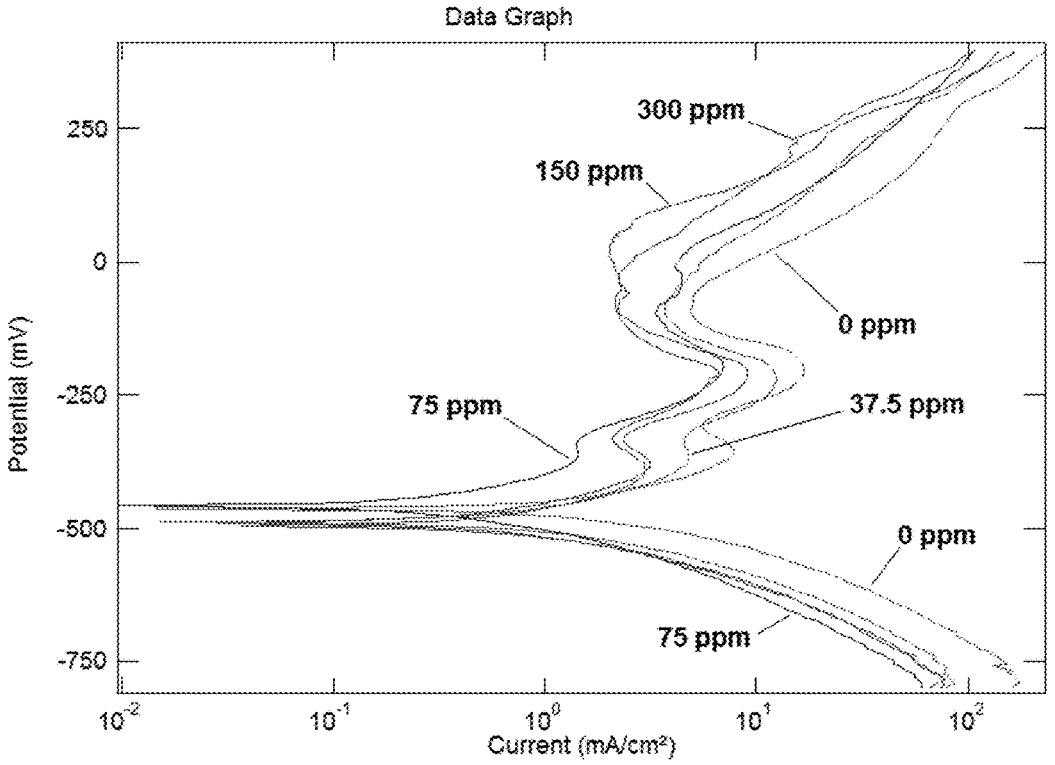
FIG. 2 shows potentiodynamic polarization curves for steel in solutions of 0.5 M HCl with 75 ppm lemon leaves extract and different concentrations of saffron leaves extracts at 25° C.
Figure 3:
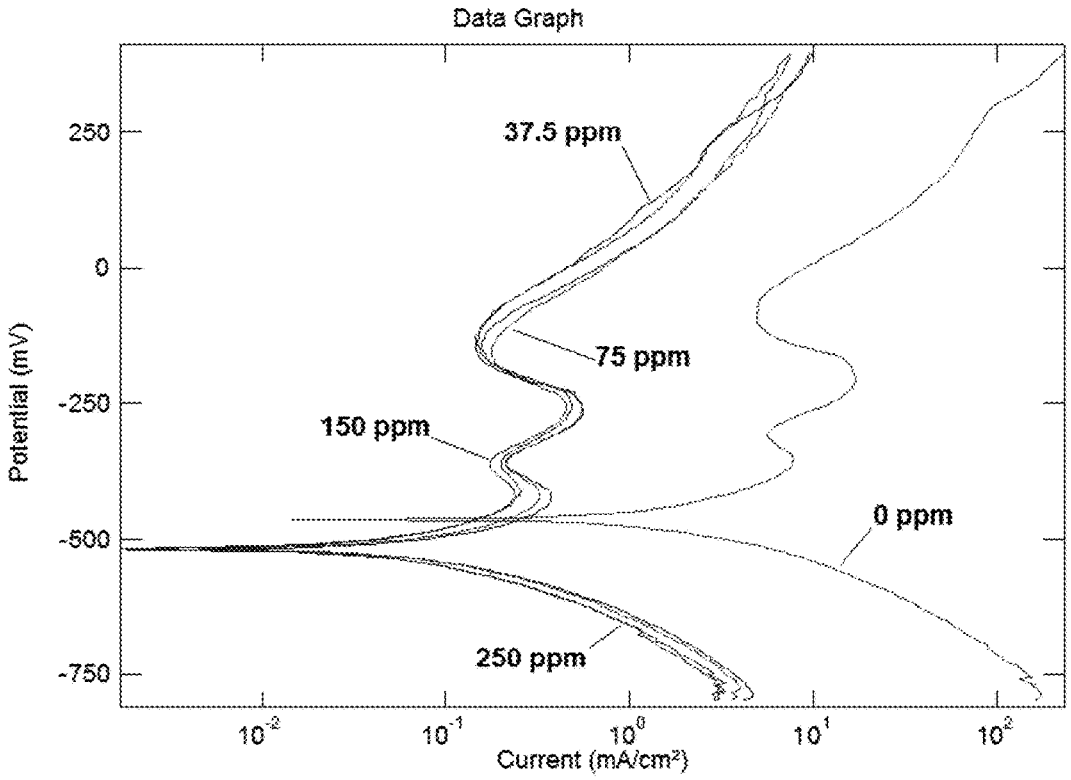
FIG. 3 shows potentiodynamic polarization curves for steel in solutions of 0.5 M HCl with 75 ppm lemon leaves extract and different concentrations of almond leaves extracts at 25° C.
Figure 4:
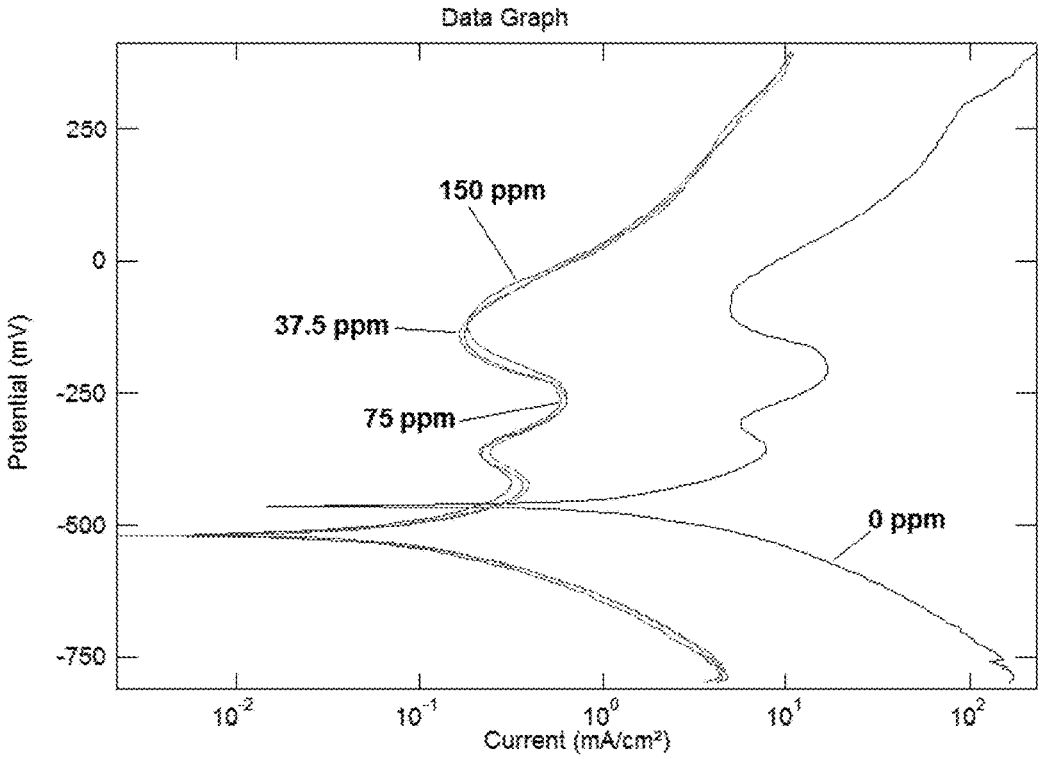
FIG. 4 shows potentiodynamic polarization curves for steel in solutions of 0.5 M HCl with 75 ppm lemon leaves extract and different concentrations of guava leaves (*Psidium guajava*) extracts at 25° C.
Figure 5:
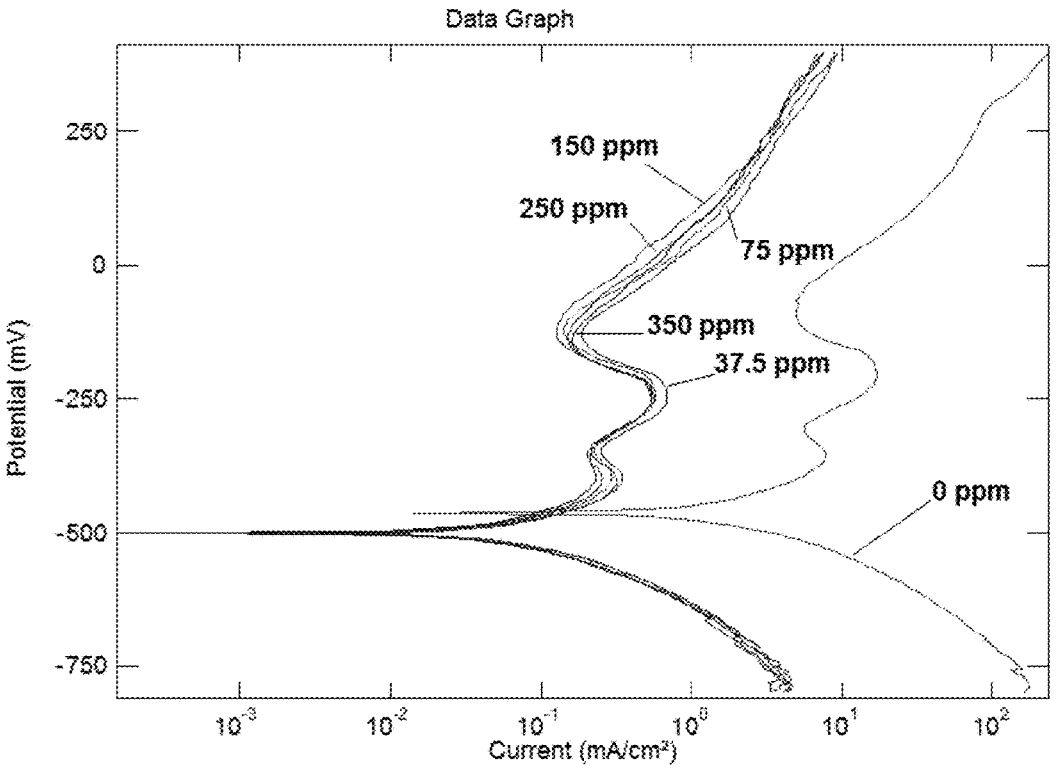
FIG. 5 shows potentiodynamic polarization curves for steel in solutions of 0.5 M HCl with 75 ppm lemon leaves extract and different concentrations of *Origanum majorana* leaves extracts at 25° C.
Figure 6:
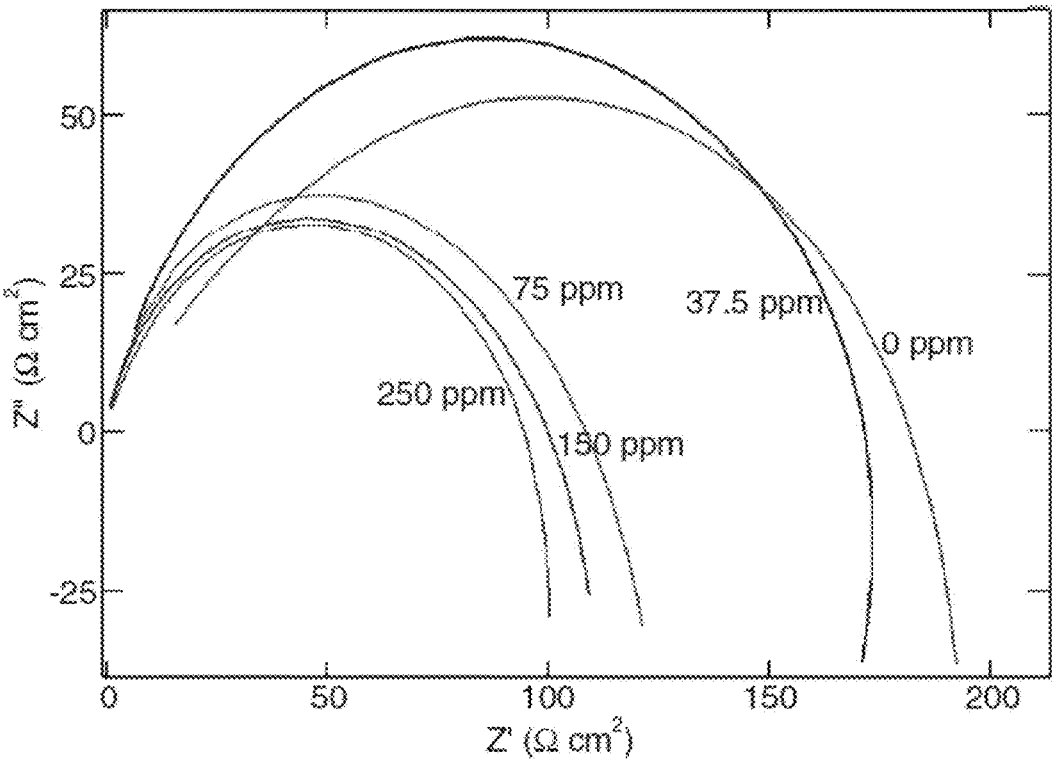
FIG. 6 shows electrochemical impedance spectra (EIS) for steel at different concentrations of lemon leaves extracts in 0.5 M HCl at 25° C.
Figure 7:
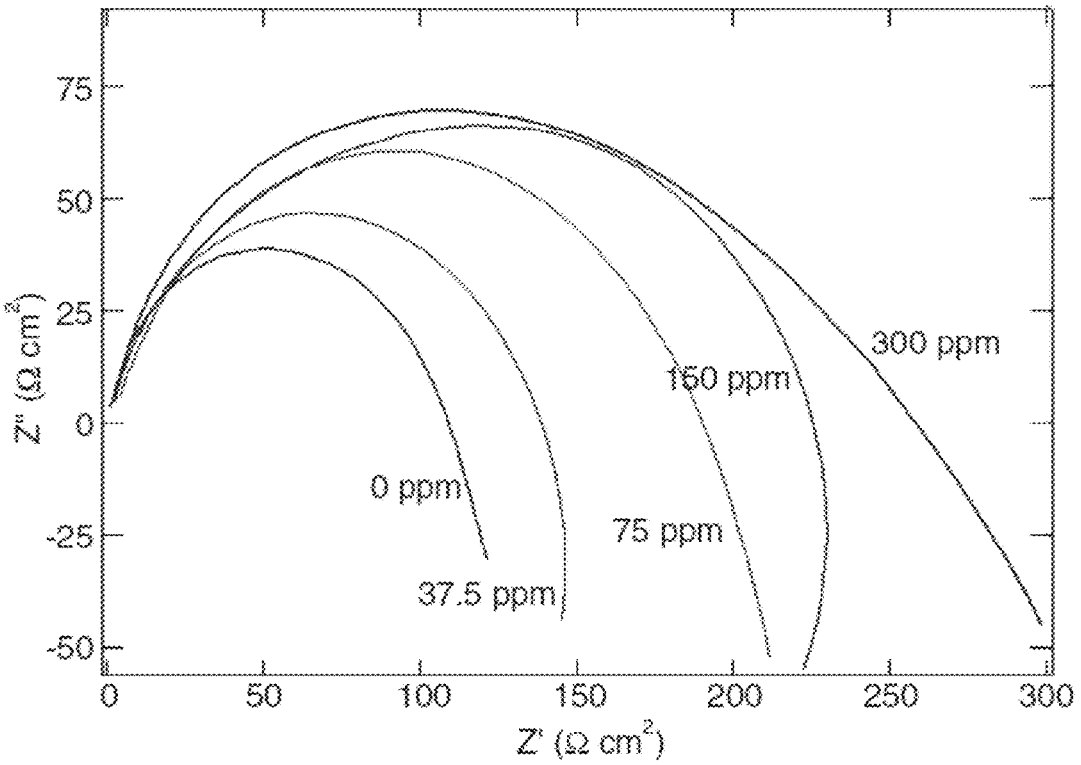
FIG. 7 shows electrochemical impedance spectra for steel in solutions of 0.5 M HCl with 75 ppm lemon leaves extract and different concentrations of saffron leaves extracts at 25° C.
Figure 8:
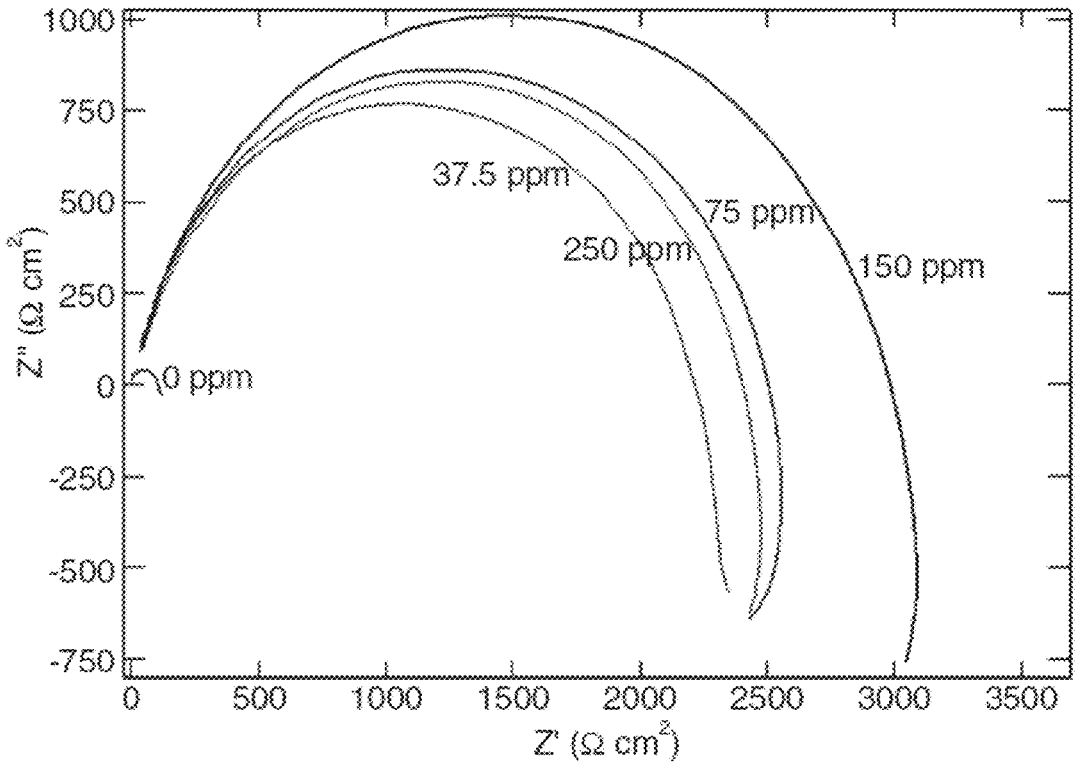
FIG. 8 shows electrochemical impedance spectra for steel in solutions of 0.5 M HCl with 75 ppm lemon leaves extract and different concentrations of almond leaves extracts at 25° C.
Figure 9:
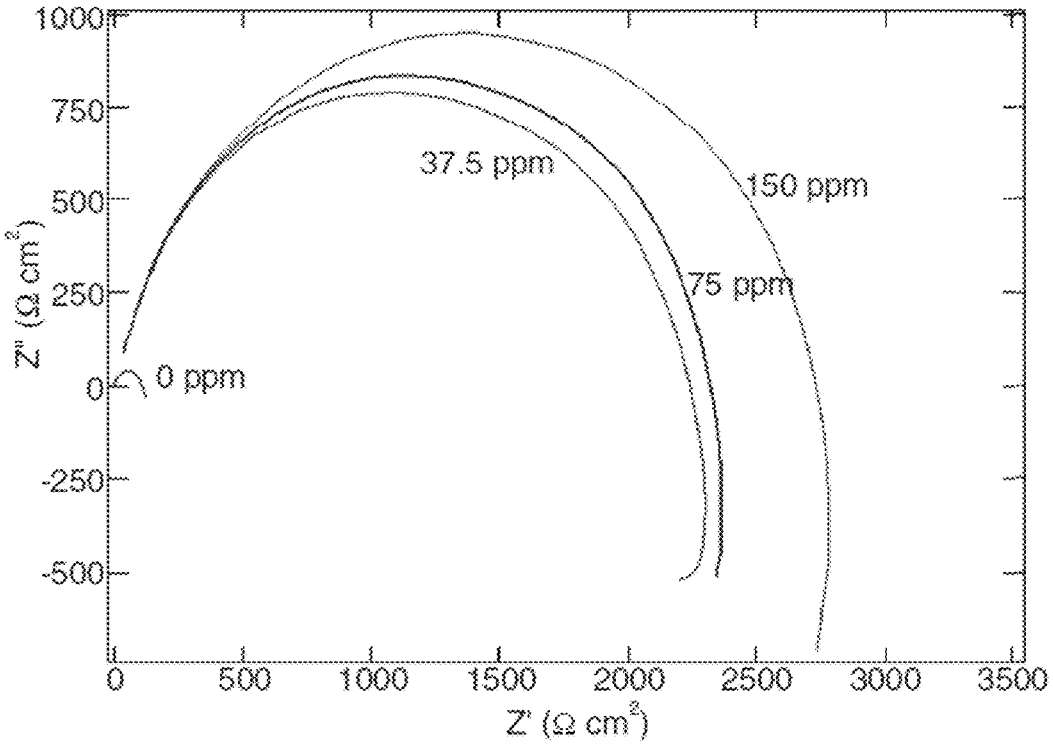
FIG. 9 shows electrochemical impedance spectra for steel in solutions of 0.5 M HCl with 75 ppm lemon leaves extract and different concentrations of guava leaves (*Psidium guajava*) extracts at 25° C.
Figure 10:
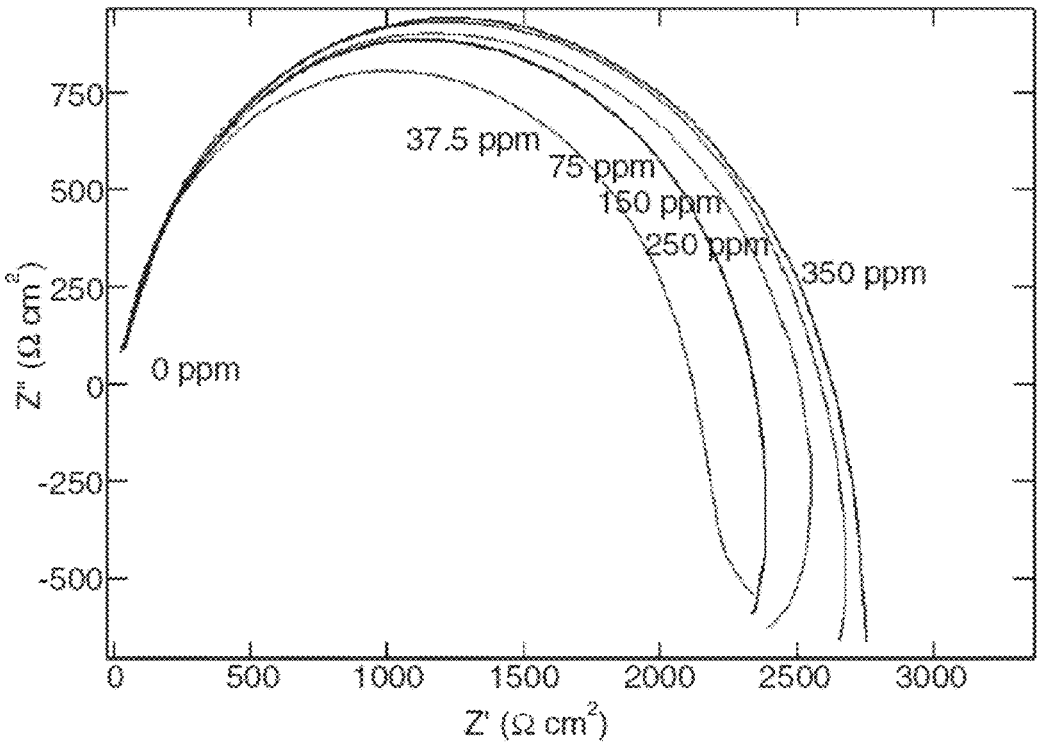
FIG. 10 shows electrochemical impedance spectra for steel in solutions of 0.5 M HCl with 75 ppm lemon leaves extract and different concentrations of *Origanum majorana* leaves extracts at 25° C.
Figure 11A:
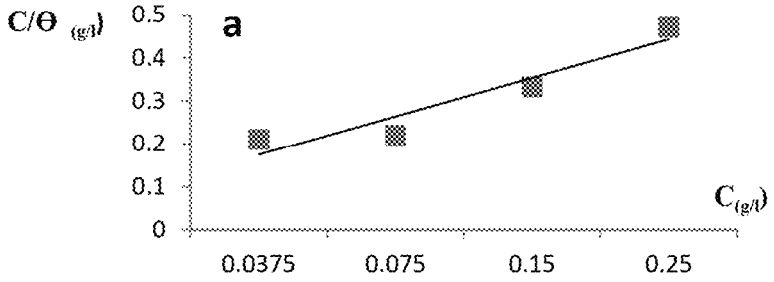
FIG. 11A shows a Langmuir adsorption plot for steel in solutions of 0.5 M HCl with 75 ppm lemon leaves extract and different concentrations of saffron leaves extracts at 25° C.
Figure 11B:
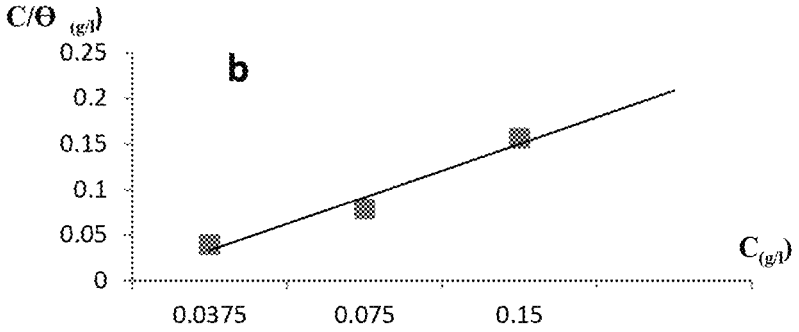
FIG. 11B shows a Langmuir adsorption plot for steel in solutions of 0.5 M HCl with 75 ppm lemon leaves extract and different concentrations of almond leaves extracts at 25° C.
Figure 11C:
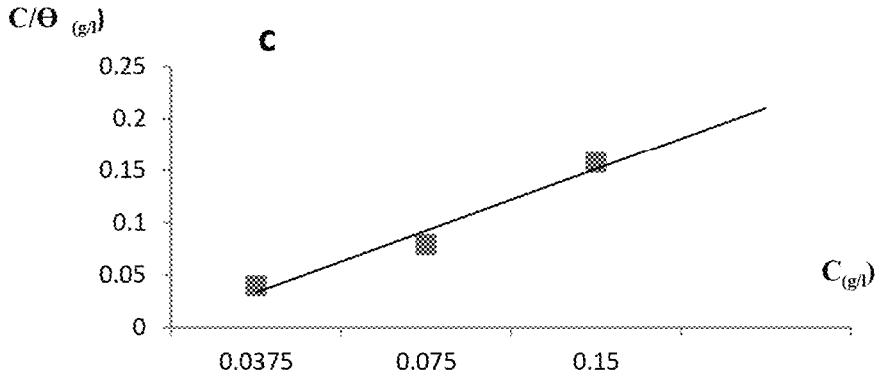
FIG. 11C shows a Langmuir adsorption plot for steel in solutions of 0.5 M HCl with 75 ppm lemon leaves extract and different concentrations of guava leaves (*Psidium guajava*) extracts at 25° C.
Figure 11D:
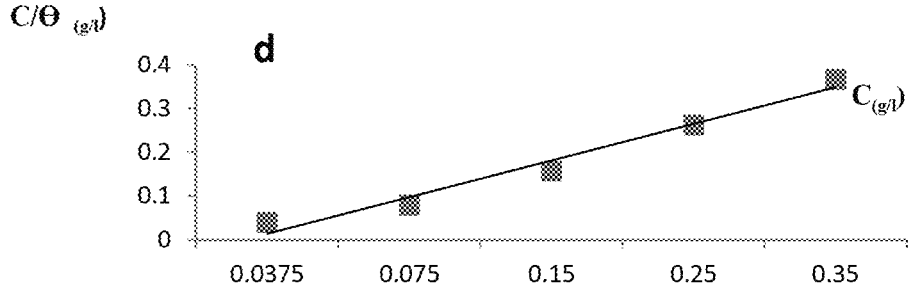
FIG. 11D shows a Langmuir adsorption plot for steel in solutions of 0.5 M HCl with 75 ppm lemon leaves extract and different concentrations of *Origanum majorana* leaves extracts at 25° C.

Embodiments of the present disclosure will now be described more fully hereinafter with reference to the accompanying drawings, in which some, but not all embodiments of the disclosure are shown.

The present disclosure will be better understood with reference to the following definitions. As used herein, the words "a" and "an" and the like carry the meaning of "one or more." Within the description of this disclosure, where a numerical limit or range is stated, the endpoints are included unless stated otherwise. Also, all values and subranges within a numerical limit or range are specifically included as if explicitly written out.

As used herein, "compound" is intended to refer to a chemical entity, whether in the solid, liquid, or gas phase, and whether in a crude mixture or purified and isolated.

The term "composition," as used herein, refers to two or more compounds that are mixed together to comprise a homogenous or heterogeneous solid, liquid, or gas.

As used herein, the term "solution" refers to a composition in a liquid state.

As used herein, "corrosion" refers to the gradual loss of a metal or alloy by its chemical reaction to its environment. For example, corrosion includes the oxidation of iron to form iron oxides. Iron oxide scale (e.g., rust) flaking from the surface of the metal causes a reduction in the mass of the metal object that is made of iron. A "corrosive agent" is a compound that causes corrosion or increases a rate of corrosion when in contact with a metal or alloy.

As used herein, a "corrosion inhibitor" refers to a compound or composition that when added to a metal or an alloy, decreases the corrosion rate of the material, or prevents corrosion from occurring.

As defined herein, "extraction," refers to a separation process where an extracting gas, liquid, and/or supercritical fluid is brought into contact with a composition whereby a compound from the composition becomes homogeneously or heterogeneously dispersed in the extracting gas, liquid, and/or supercritical fluid. Preferably, "extraction" refers to the physical transfer of a compound from the composition and into the extracting gas, liquid, and/or supercritical fluid, and either a portion or all of the compound is transferred. However, in some cases reagents may be used to react with or digest a part of the composition in order to release a compound. For example, a cellulase enzyme may be used to break up a composition comprising a cellulose matrix, in order to release compounds retained within.

As defined herein, an "extract" refers to a compound separated from a composition by an extraction process. An extract may also refer to the mixture of both the extracting gas, liquid, and/or supercritical fluid and the extracted compound. In other cases, an "extract" may refer to only an extracted compound or compounds. Furthermore, an extract may be diluted, concentrated, purified, dried, or reconstituted and still be referred to as an "extract."

As used herein, "lemon" refers to the *Citrus x limon* plant, which may also use the name of *Citrus limon* or lemon tree. Additionally, "leaf" and "leaves" are used interchangeably. Where "leaf" and "leaves" refer to two plant materials having the same mass, the same state (i.e. fresh or dried), and the same species, the plant materials are considered to be chemically equivalent. For instance, 0.5 g plant material cut and crushed from one fresh leaf of a *Citrus x Limon* plant is considered to be chemically equivalent to a total of 0.5 g plant material cut and crushed from more than one fresh leaf from one or more *Citrus x Limon* plants. Unless otherwise noted, a "lemon leaf extract" is considered to be chemically equivalent to a "lemon leaves extract."

According to a first aspect, the present disclosure relates to a method of inhibiting corrosion of steel. The method comprises the step of contacting a surface of steel with a solution comprising 20-300 ppm, preferably 40-200 ppm, more preferably 50-100 ppm of a citrus leaf extract and 20-450 ppm, preferably 100-425 ppm, more preferably 200-400 ppm of a second leaf extract to form a treated steel. As defined here, steel is an alloy having 55-99.98 wt %, preferably 60-99.96 wt % of elemental iron, and may further comprise carbon, chromium, aluminum, nickel, molybdenum, manganese, vanadium, tungsten, cobalt, titanium, niobium, copper, zirconium, calcium, boron, phosphorus, and/or silicon. "Inhibiting corrosion" means that the treated steel has a reduced rate of corrosion, or no detectable corrosion. "Inhibiting corrosion" also includes preventing corrosion. The solution may be applied to a surface of steel as a preventative measure when no corrosive agent is present.

The steel may be a part of a building, a bridge, a sign, a sculpture, an intermodal container, a wire, a train car, a railing, a cable, a ship, an automobile, a fire hydrant, a mailbox, a bicycle, a fence, a scaffolding, a pipeline, an oil well, a gas well, a storage tank, a construction equipment, a battery, a chain link, or a piece of furniture. Preferably the steel may be located outdoors, though in some instances the steel may be located indoors, such as an air duct, an exhaust hood, a plumbing, an electrode, or a part of an appliance. Preferably the steel may be prone to rusting or corrosion, such as steel located outdoors or otherwise exposed to humidity, acids, salts, or some other corrosive agent. For testing purposes, the steel may be an electrode, wire, coupon, chad, scrap, or panel with a total surface area of 0.1-1,800 $cm^2$, preferably 0.5-500 $cm^2$, more preferably 0.5-50 $cm^2$. The steel may be one or more types of carbon steel, stainless steel, weathering steel, steel wool, Eglin steel, austenitic steel, ferritic steel, martensitic steel, and/or some other type of steel.

In one embodiment of the method, the steel comprises 0.05-1.0 wt % carbon, preferably 0.05-0.6 wt % carbon, more preferably 0.05-0.25 wt % carbon relative to a total weight of the steel. Steel comprising 0.05-2.0 wt % carbon may be referred to as carbon steel, and within that range, steel comprising 0.05-0.25 wt % carbon may be referred to as mild steel. In alternative embodiments, carbon steels comprising 1.0-2.1 wt % carbon may be used. In other alternative embodiments, other metals and metal alloys prone to corrosion may take the place of the steel, such as copper, silver, aluminum, or pure iron. In one embodiment, the steel comprises 99.1-99.5 wt % iron, 0.4-0.8 wt % manganese, 0.1-0.3 wt % carbon, 0.02-0.06 wt % phosphorus, and 0.001-0.005 wt % Si.

In one embodiment, the citrus leaf extract is from a leaf or leaves of one or more plants in the *Citrus* genus, such as *Citrus maxima* (pomelo), *Citrus medica* (citron), *Citrus micrantha* (papeda), *Citrus reticulata* (mandarin orange), *Citrus japonica* (kumquat), *Citrus australasica* (red finger lime), *Citrus x aurantiifolia* (key lime), *Citrus x aurantium* (bitter orange), *Citrus hystrix* (kaffir lime), *Citrus x latifoha* (persian lime), *Citrus x Limon* (lemon), *Citrus x limonia* (rangpur), *Citrus x paradisi* (grapefruit), *Citrus x sinensis* (sweet orange), *Citrus x tangerina* (tangerine), *Citrus x clementina* (clementine) or some other species or hybrid. Preferably the leaf is fresh, meaning that it was harvested within 3 days, preferably within 2 days. A harvested leaf may be refrigerated in a sealed container to maintain freshness until the extraction. In an alternative embodiment, a different part of the citrus plant may be extracted, such as the seed, peel, zest, rind, pulp, juice, flower, nectar, pollen, stem, bark, or root.

The leaf may be extracted into water, and/or one or more organic solvents such as methanol, ethanol, acetone, hexane, isopropanol, n-propanol, sec-butanol, n-butanol, isobutanol, tert-butanol, glycerol, diethyl ether, ethylene glycol, propylene glycol, polyethylene glycol, carbon tetrachloride, chloroform, or tetrachloroethylene. The water may be tap water, distilled water, bidistilled water, deionized water, deionized distilled water, reverse osmosis water, and/or some other water. In one embodiment, the water is bidistilled to eliminate trace metals. Preferably the water is bidistilled, deionized, deinonized distilled, or reverse osmosis water and at 22-27° C. has a conductivity of less than 10 $\mu S \cdot cm^{-1}$, preferably less than 1 $\mu S \cdot cm^{-1}$, a resistivity greater than 0.1 $M\Omega \cdot cm$, preferably greater than 1 $M\Omega \cdot cm$, more preferably greater than 10 $M\Omega \cdot cm$, a total solid concentration less than 5 mg/kg, preferably less than 1 mg/kg, and a total organic carbon concentration less than 1000 μg/L, preferably less than 200 μg/L, more preferably less than 50 μg/L.

Where water and one or more organic solvents are used together as extraction medium, the extraction medium may comprise 30-99 wt %, preferably 50-90 wt %, more preferably 60-80 wt % water based on the total extraction medium weight. For example, an extraction medium may comprise 75-80 wt % water and 20-25 wt % ethanol. In other embodiments, the extraction medium may comprise 1-70 wt %, preferably 10-50 wt %, more preferably 20-40 wt % of one or more organic solvents relative to the total extraction medium weight. The water and one or more organic solvents may be miscible, partially miscible, or immiscible. Where two organic solvents are used, they may have mass ratios of 10:1-1:10, preferably 5:1-1:5, more preferably 2:1-1:2 with each other. In one embodiment, water may not be used in the extraction medium, however, water may transfer from a citrus leaf into the extraction medium.

In a preferred embodiment, water may be used as the extraction medium to produce an aqueous extract. As defined here, an aqueous extract is formed when an extraction process is carried out using a liquid extraction medium comprising 65-100 wt % water, preferably 70-100 wt % water, more preferably 80-100 wt % water.

In one embodiment of the method, the citrus leaf extract is an aqueous extract from the leaf of a *Citrus x limon* plant.

In one embodiment, a reagent may be added to a liquid extracting medium to improve extraction efficiency, and the reagent may be an acid, base, salt, surfactant, or enzyme. One or more of these reagents may be added until the amount of reagent reaches 0.001-5 wt %, preferably 0.01-2 wt %, more preferably 0.1-1 wt % of the total liquid extracting medium and reagent weight. The acid may be carbonic acid, sulfuric acid, hydrochloric acid, formic acid, citric acid, malic acid, adipic acid, tannic acid, lactic acid, ascorbic acid, acetic acid, fumaric acid, and mixtures thereof. The bases may be sodium hydroxide, lithium hydroxide, potassium hydroxide, sodium carbonate, potassium carbonate, sodium bicarbonate, potassium bicarbonate, magnesium carbonate, calcium carbonate, ammonium hydroxide, substituted amine bases, ammonia, and mixtures thereof. The salt may be sodium chloride, sodium nitrate, potassium chloride, calcium chloride, magnesium chloride, ammonium chloride, sodium bromide, potassium bromide, calcium bromide, magnesium bromide, ammonium bromide, sodium iodide, potassium iodide, calcium iodide, magnesium iodide, ammonium iodide, sodium sulfate, potassium sulfate, calcium sulfate, magnesium sulfate, ammonium sulfate, and mixtures thereof. Surfactants are compounds that lower the surface tension of a liquid, the interfacial tension between two liquids, or between a liquid and a solid. Surfactants may act as detergents, wetting agents, emulsifiers, foaming agents, and dispersants. The surfactant may be cationic, anionic, or nonionic and may include polysorbate 20, polysorbate 40, polysorbate 60, polysorbate 80, Triton X-100, sodium dodecylbenzenesulfonate, cetrimonium bromide, benzalkonium chloride, and sodium lauryl sulfate. An enzyme may be a lipase, glucoamylase, a cellulase, bromelain, an amylase, papain, hemicellulase, phytase, a nuclease, pepsin, trypsin, or some other protease. In one embodiment, enzymes may be used to target the plant cell wall, such as amylase and cellulase.

The citrus leaf may be dried, crushed, blended, or cut before the extraction in order to increase the surface area exposed to the extracting medium. As defined here, a dried plant part, such as a citrus leaf, refers to a plant part having a total water content of 0-7 wt %, preferably 0-6 wt %, more preferably 0-5 wt % of the total weight of the plant part. Preferably, a dried citrus leaf is crushed or cut before mixing with the liquid extraction medium. Alternatively, a fresh or dried citrus leaf may be mixed with an extracting medium and then crushed, blended, or cut, for example, with an immersion blender. Other mechanical stress may be applied to a *citrus* leaf by freezing, sonication, extrusion, or osmotic shock.

The citrus leaf extract may be made by combining one or more citrus leaves, or a portion of a citrus leaf, with the liquid extraction medium, where the citrus leaf to liquid extraction medium mass ratio is 0.01:1-1:1, preferably 0.10:1-0.5:1, more preferably 0.12:1-0.2:1. The mixture may be stirred, agitated, or left to sit for 0.25-48 h, preferably 12-40 h, more preferably 20-30 h, at a temperature of 50-125° C., preferably 55-80° C., more preferably 60-70° C. Preferably the heating may be with a bottom heating element and a loosely covered lid to limit liquid loss by evaporation. The bottom heating element may be a hot plate, coil, induction element, flame, or heating mantle. Alternatively, a convection oven, a microwave oven, a steam manifold, or an autoclave may be used for the heating. For instance, an autoclave may be used to heat the citrus leaves and extraction medium to 100-120° C., or higher temperatures such as 130° C. In an alternative embodiment, the citrus leaves and medium may be refluxed. After the heating, the solids may be removed from the extraction medium by filtering, centrifugation, or by evaporating and condensing the extract and extraction medium. The strength of this extract may be represented in terms of ppm of the starting mass of citrus leaves in relation to the mass of the solution. For instance, 3.0 g citrus leaves placed in 20 mL water has a citrus leaf to liquid extraction medium mass ratio of 0.15:1, which is equivalent to 0.15 g leaves per g water. In ppm, this would be $0.15\times10^6$ ppm=$1.5\times10^5$ ppm. The extract may be diluted to lower ppm concentrations by mixing with water or other solutions. Note that the "ppm" does not refer to the amount of dissolved or extracted compounds, but instead refers to the ratio of the initial mass of leaves or plant material with respect to the mass of water or solvent initially mixed. For instance, an extract may be diluted to a concentration of 150 ppm in a volume of 1 L water (i.e., 1 kg water), but contain significantly less than 150 mg dissolved compounds (i.e., 150 parts mass compounds per million parts mass of solution, with 1 mg/kg=1 ppm). This difference arises from the fact that the solid leaf compounds are removed after the heating. However, in an alternative embodiment, the citrus leaf may be added as a fine powder having an average particle diameter of 0.5-50 μm, preferably 1-40 μm, more preferably 3-25 μm and may not be removed from the solution. In one embodiment, the citrus extract may be diluted in the solution to a concentration of 20-300 ppm, preferably 50-200 ppm, more preferably 50-100 ppm. In another alternative embodiment, a citrus leaf may be added to a large volume of an extraction medium to achieve an equivalent 20-300 ppm concentration without requiring a dilution step. For example, a 250 ppm lemon leaf extract may be made by putting 0.5 g lemon leaves into 2 kg of an extraction medium. Following the extraction, the lemon leaves may be removed and the extract may be used without any dilution required.

In an alternative embodiment, a citrus leaf extract may be formed not with a liquid medium but with a gas phase medium or a medium in a supercritical fluid state. Alternatively, the medium may have a mixed state, such as vapor droplets (for example, saturated or wet steam).

Referring again to the first aspect, the solution further comprises a second leaf extract. Preferably, this second leaf extract is from a leaf of a non-citrus plant, meaning a plant that is not a member of the *Citrus* genus. In one embodiment, this may be an extract from the leaf of a tobacco plant (for example, *Nicotiana tabacum* or *Nicotiana rustica*), paprika (*Capsicum annuum*), clove (*Syzygium aromaticum*), cinnamon (for example, species of the *Cinnamomum* genus), black pepper (*Piper nigrum*), pomegranate (*Punica granatum*), coriander or cilantro (*Coriandrum sativum*), arugula (*Eruca sativa*), gingko (*Ginkgo biloba*), henna (*Lawsonia inermis*), reed (*Phragmites australis*), roselle (*Hibiscus sabdariffa*), *Tiliacora acuminata*, tea (*Camellia sinensis*), lemon balm (*Pelargonium x melissinum*), lemongrass (*Cymbopogon citratus*), lemon verbena (*Aloysia citrodora*), lemon thyme (*Thymus citriodorus*), southern *magnolia* (*Magnolia grandiflora*), saffron (*Crocus sativus*), almond (*Prunus dulcis*, a.k.a. *Prunus amygdalus*), guava (*Psidium guajava*), marjoram (*Origanum majorana*), or some other plant. The second leaf extract may be extracted by a method or medium similar to that discussed for the citrus leaf extract, and at a similar range of concentrations or mass ratios. The second leaf extract may also be dried, crushed, blended, or cut before the extraction, similar to the citrus leaf. In one embodiment of the method, the second leaf extract is an aqueous leaf extract from a saffron plant, an almond plant, a *Psidium guajava* plant (guava), and/or an *Origanum majorana* plant (marjoram). The solution may comprise the second leaf extract at a concentration of 20-450 ppm, preferably 200-450 ppm, more preferably 300-450 ppm. In an alternative embodiment, instead of a second leaf extract, an extract from a seed, peel, pulp, husk, juice, flower, nectar, pollen, stem, bark, secretion, or root of a non-citrus plant may be used at a similar concentration.

In a further embodiment, the solution comprises 50-100 ppm, preferably 60-80 ppm, more preferably 70-80 ppm of the citrus leaf extract and 300-450 ppm, preferably 325-400 ppm, more preferably 340-370 ppm of the aqueous leaf extract from an *Origanum majorana* plant. In one preferred embodiment, the solution comprises 75 ppm of the citrus leaf extract and 350 ppm of the *Origanum majorana* aqueous leaf extract.

The citrus leaf extract, the second leaf extract, or both may comprise compounds such as phytosterols, acyl lipids, nucleotides, amino acids, carbohydrates, polysaccharides, saponin, alkyloids (such as theobromine), anthraquinone, cholorophyll, vitamins, organic acids, glycocides, phenolic compounds (such as flavonoids, tannins, lignin, catechins, and salicylic acid), or terpenoids (such as aromatic oils, resins, waxes, terpenes, steroids, and carotenoids). The compounds may be primary or secondary metabolites, or may be compounds from any part of a plant cell or secretion.

The compounds of a citrus leaf extract may be mostly essential oils, for example, essential oils may be present at a weight percentage of 60-98 wt %, preferably 65-95 wt %, more preferably 70-90 wt % of the total weight of the extracted compounds. Alternatively, the compounds of a citrus leaf extract may contain mostly aqueous compounds, for example, aqueous compounds may be present at 60-95 wt %, preferably 70-92 wt %, more preferably 75-90 wt % of the total weight of the extracted compounds. In another embodiment, a citrus leaf extract may have a mass ratio of essential oils to aqueous compounds of 1.2:1-1:1.2, preferably 1.1:1-1:1.1, or about 1:1.

The citrus leaf extract compounds may include essential oils such as linalyl 2-aminobenzoate, β-linalool, α-terpineol, limonene, citronellal, citronellol, citronellyl acetate, isopulegol, linalool, erucylamide, citral, linalyl acetate, trans-β-ocimene, and methoprene. In one embodiment, the citrus leaf extract may have erucylamide present at a weight percentage of 15-40 wt %, preferably 20-35 wt % in relation to the total weight of the extracted essential oils. Likewise, the citrus leaf extract may have limonene present at a weight percentage of 10-25 wt %, preferably 12-22 wt % of the total weight of the extracted essential oils, and citral at 5-20 wt %, preferably 7-18 wt %. Preferably the weight of erucylamide in a citrus leaf extract is 0.2-20 times greater, preferably 1-10 times greater than the weight of erucylamide in an extract from a citrus stem, citrus seed, citrus peel, or citrus flower, using equivalent extraction methods and masses of reagents/materials. In another embodiment, the essential oils of the extract may comprise monoterpenes at a weight percentage of 55-85 wt %, more preferably 60-80 wt % of the total weight of the essential oils. In this embodiment, the essential oils of the extract may comprise limonene at 40-75 wt %, more preferably 50-65 wt % of the total weight of the extracted essential oils, and linalool at 4-15 wt %, preferably 6-12 wt %. The citrus leaf extract compounds may have a mol percentage of rhiofolin, naringin, meranzin hydrate, citral, or isoimperatorin that is 20-90% lower, preferably 30-85% lower, more preferably 40-80% lower than that of a citrus fruit extract or citrus flower extract. The citrus leaf extract may include fatty acids such as linoleic acid, linolenic acid, oleic acid, palmitic acid, and palmitoleic acid. The citrus leaf extract may include coumarins such as aurapten, auraptene, limettin, umbelliferone, and osthol at a wt % of less than 1 wt %, preferably less than 0.5 wt % of the total mass of the extracted compounds. The citrus leaf extract may also contain metals. For instance, a lemon leaf extract may contain calcium at 2-6 wt %, preferably 3-5 wt %, potassium at 0.1-2 wt %, preferably 0.2-1.0 wt %, magnesium at 0.10-0.80 wt %, preferably 0.15-0.45 wt %, of the total weight of the extracted compounds. In one embodiment, the composition of the citrus leaf extract may depend on soil conditions, time of day, age of leaf, location, and weather being exposed to the citrus plant from which the leaf is harvested.

Preferably a compound of the second leaf extract is a corrosion inhibitor. In one embodiment, one or more compounds from the citrus leaf extract and the second leaf extract is a corrosion inhibitor. In one embodiment, the citrus leaf extract may or may not contain a corrosion inhibitor, but may comprise one or more corrosion inhibitor intensifiers. This corrosion inhibitor intensifier may not have significant corrosion inhibition activity on its own, but may increase the corrosion inhibition efficiency of the solution while in the presence of a corrosion inhibitor.

In the extraction, compounds of a polarity like the extraction medium may be extracted, for instance, polar compounds may be extracted by water or an aqueous solution. However, in some instances, a polar extraction medium may extract non-polar compounds, and a non-polar extraction medium may extract polar compounds. This may occur by mechanical disturbance, for example, by blending a plant leaf in an extraction medium.

In one embodiment, the citrus leaf extract and the second leaf extract may be made simultaneously in the same volume of a liquid extraction medium. For instance, lemon leaves and almond leaves may be mixed in the same volume of water and heated at 50-125° C. for 0.25-48 h. Alternatively, the citrus leaf extract and the second leaf extract could be made with the same volume of liquid extraction medium, but be heated separately. For instance, citrus leaves may be heated first in a volume of liquid extraction medium, removed by filtration, and then marjoram leaves may be mixed and heated in the same volume of liquid extraction medium. In another embodiment, the citrus leaf extract and the second leaf extract may be made in separate volumes of extraction media and then mixed or diluted together to a desired concentration. In one embodiment, the citrus leaf extract, the second leaf extract, or both may be dried and reconstituted at a later time to form the solution, and the reconstituting may be done with water or some other solvent as mentioned previously. The extracts may be dried by a low pressure evaporator, a spray tower, or a freeze dryer. Preferably the dried extracts contain 0-1.5 wt % of water per total weight of the extract, preferably 0.01-1.0 wt %, more preferably 0.1-0.8 wt %. In another embodiment, the citrus leaf extract, the second leaf extract, or both may be concentrated by evaporating a part of the solution. A concentrated extract may be later diluted to a desired concentration.

In one embodiment of the method, the solution further comprises a carrier agent or a stabilizing agent. The solution may comprise 0.01-50 wt %, preferably 0.1-40 wt %, more preferably 1-20 wt % of the carrier agent or stabilizing agent relative to the total solution weight. The solution may comprise both a carrier agent and a stabilizing agent, or more than one carrier agent and/or stabilizing agent. As used herein, a carrier agent may be a compound that assists in transferring the citrus leaf extract and the second leaf extract of the solution onto the surface of the steel. For instance, a carrier agent may allow the solution to be sprayed more effectively or may help the solution dry more quickly. In a further embodiment, where the solution has a carrier agent, the carrier agent is methanol, ethanol, isopropanol, ethylene glycol, propylene glycol, dimethylformamide, dimethyl sulfoxide, N-methyl pyrrolidone, propylene glycol methyl ether, 2-butoxyethanol, and/or a hydrofluoroalkane. As used herein, a stabilizing agent reduces the rate of degradation of the citrus leaf extract and/or the second leaf extract of the solution. This degradation may be caused by oxidation, microbes, hydrolysis, and/or proteases. In a further embodiment, where the solution has a stabilizing agent, the stabilizing agent is acetic acid, a citrate buffer, a borate buffer, a phosphate buffer, benzalkonium chloride, butylated hydroxytoluene, butylated hydroxyanisole, ethylenediaminetetraacetic acid (EDTA), and/or ethylene glycol-bis(β-aminoethyl ether)-N,N,N',N'-tetraacetic acid (EGTA).

In one embodiment of the method, the contacting is done by spraying, submerging, painting, or spin coating the steel. Spraying may involve an air pressurized nozzle to transfer the solution onto a steel surface. The spraying may include a heating unit to retain the solution at low viscosity for a more evenly dispersed spray profile, or the solution may further comprise a carrier agent to provide a low viscosity. The low viscosity may be a viscosity less than 1.2 cP, less than 1.0 cP, less than 0.75 cP, or less than 0.5 cP. In a further embodiment, where the contacting is done by spraying, the solution may be applied as an aerosol. Aerosols include all self-contained pressurized products, and the solution may be emitted as a mist, spray, or foam, by a pressurized propellant, foam, or semisolid liquid. The solution may also be emitted by an unpressurized atomizer that is pressurized by a hand-operated or electric pump without using a stored propellant. In one embodiment, the aerosol comprises a container, a propellant, the solution comprising the citrus leaf extract and the second leaf extract, a valve (which may be a metered valve), and an actuator. The nature of these components determines characteristics such as delivery rate, spray density, and fluid viscosity. In another embodiment, the aerosol is a two-phase formulation comprising a gas and liquid. In another embodiment, the aerosol is a three-phase formulation comprising a gas, liquid, and suspension or emulsion of the citrus leaf extract and the second leaf extract. In this formulation, other carrier agents, such as wetting agents and/or solid carriers such as talc or colloidal silica may be included. In another embodiment, the propellant is liquefied or vaporized, and may be carbon dioxide, nitrogen, air, argon, propane, n-butane, isobutene, dimethyl ether, methoxyethane, 1,1,1,2,-tetrafluoroethane, 1,1,1,2,3,3,3-heptafluoropropane, 1,1-difluoroethane, 1,1,1-trifluoroethane, nitrous oxide, or any mixture thereof.

Submerging is a process in which the steel is immersed in a container filled with the solution to adhere the solution to the steel surface. Submerging may also be called soaking, immersion, dipping, or dip coating. The steel may be immersed for 2 s-3 h, preferably 15 s-1 h, more preferably 15 s-10 min. Alternatively, the steel may be immersed indefinitely, or for a length of time to achieve a maximum corrosion inhibition. The submerging may be followed by draining off an excess of the solution from the steel and then drying or baking the steel to solidify or dry the solution onto the steel surface. Painting may include employing bristles, rollers, stamps, or sponges to apply the solution onto the steel. In spin coating, the solution may be applied to a central region of a flat surface of the steel. The flat surface is then rotated on an axis normal to the surface and in the central region, to spread the solution by centrifugal force. An excess of the solution may spin off the edges of the surface. Alternatively, a solution may be applied to a steel surface and then spread by gravity or by blowing the applied solution with a compressed gas. In another alternative embodiment, the solution may be dripped or poured onto the steel surface. In an alternative embodiment, the extracts may be applied to the same surface, but from separate solutions. For example, a solution comprising 20-300 ppm of a citrus leaf extract may be applied first, and then a solution comprising 20-450 ppm of the second leaf extract may be applied to the same surface. In a further embodiment, the first solution applied may be dried or allowed to dry before applying the second solution.

In one embodiment, the steel may be cleaned before the contacting to remove superficial impurities such as oxides, grime, and dirt. The cleaning may be done by acid etching, UV irradiation, sonication, soaking, or scrubbing, and may use water, an acid, a base, a surfactant, and/or an organic solvent from those mentioned previously. The cleaning may involve polishing without using a solution. In one embodiment, the steel may be polished with emery paper or sandpaper, rinsed with acetone, and then rinsed with distilled water.

In some embodiments, the solution may be dried onto the surface of the steel to form a coating to inhibit corrosion. The solution may be dried with a heat lamp, a flow of heated or unheated air or inert gas, an oven, a flame, freeze drying, or may be left to dry on its own. In one embodiment, the solution further comprises crosslinking elements that may be crosslinked by irradiation, heating, radical polymerization, natural oxidation, or heat-induced oxidation. Crosslinking elements may be compounds such as acrylamide, bisacrylamide, polyethylene, vinylsilane, tannin, formaldehyde, polyvinyl acetate, hexamine, cyanoacrylate, and methacrylic acid. The solution may be crosslinked in its original liquid state, or may be dried to form a coating which is then crosslinked. This crosslinking of the composition may form a varnish on the surface of the steel. The crosslinking may also result from chemical modification by processes including, but not limited to, hydrogenation, epoxidation, hydroxylation, halogenation, sulfonation, phosphorylation, and amidation. In some embodiments, the solution may be dried and then coated with a paint, dye, polish, sealant, primer, tar, adhesive, or cement.

In some embodiments, a solution containing a citrus leaf extract concentration much greater than 300 ppm and/or a second leaf extract concentration much greater than 450 ppm may be used to contact a steel surface. For instance, a solution may have either or both leaf extracts present at 0.1-30 wt %, preferably 1-20 wt % of the total solution weight. A solution in contact and drying on a steel surface may achieve these and higher weight percentages as the water or solvent of the solution evaporates. Alternatively, the citrus leaf and/or second leaf may be ground, cut, blended, pressed, or extruded, and applied as a paste. This paste may contain water or solvent at a weight percentage of 10-50 wt %, preferably 15-40 wt % of the total paste weight. In a related alternative embodiment, a citrus leaf and/or second leaf may be placed on a steel surface and then smeared, crushed, grounded, or pressed on the steel surface.

In some embodiments, a corrosion inhibitor from the solution may adsorb to the surface of the steel by chemisorption and/or physisorption mechanisms, and may follow a Langmuir adsorption isotherm, a Freundlich adsorption isotherm, a Temkin adsorption isotherm, a Brunauer-Emmett-Teller adsorption model, or may not follow any particular adsorption isotherm or model. The chemisorption process occurs when nucleophilic electrons are donated to the surface the steel, and this interaction is facilitated by the non-bonded electrons and $\pi$-electrons of the corrosion inhibitors, especially those with aromatic and hydrophobic tail moieties. This interaction allows the corrosion inhibitor to form strong electronic bonds with the metallic surface. Physisorption takes place when a corrosion inhibitor adheres to the steel surface and forms a protective film. This interaction may be enhanced by alkyne moieties. The corrosion inhibitor may form an electrically insulating and/or chemically impermeable coating, which suppresses or prevents anodic or cathodic electrochemical reactions on the steel surface. Preferably one or more corrosion inhibitors in the solution act as a mixed corrosion inhibitor, in which both anodic and cathodic reactions on the steel surface are suppressed. In some embodiments, a corrosion inhibitor or other compound may not adsorb to the surface of the steel but to a corrosion inhibitor already adsorbed to the surface of the steel. In one embodiment of the method, the citrus leaf extract, the second leaf extract, or both is adsorbed onto a 0.90-0.97 surface area fraction of the steel, preferably 0.91-0.95, more preferably 0.92-0.94, and this adsorption may result from chemisorption and/or physisorption mechanisms. Preferably the second leaf extract is adsorbed by physisorption. As used above, the second leaf extract adsorbing on the surface of the steel means that at least one compound of the second leaf extract adsorbs, and does not require all compounds of the second leaf extract to adsorb. The same applies for the citrus leaf extract adsorbing.

In one embodiment, the solution may further comprise a corrosion inhibitor intensifier such as potassium iodide, cuprous chloride, a quaternary ammonium compound, an antimony-based compound, and/or a bismuth-based compound. The corrosion inhibitor intensifier may be present in an amount of 0.001-5 wt %, preferably 0.01-3 wt %, more preferably 0.1-1 wt % relative to the total weight of the solution. Where the solution further comprises two corrosion inhibitor intensifiers, they may have mass ratios of 10:1-1:10, preferably 5:1-1:5, more preferably 2:1-1:2 with each other.

In another embodiment, the solution may further comprise a corrosion inhibitor that is not derived from a plant extract. The corrosion inhibitor may be a surfactant, bis-(2-benzothiazolyl)-disulfide, a dye, an antibiotic, an antihistamine, thiourea, caffeic acid, an aminoacid, betanine, a guanidine derivative, a barbiturate, phenyldimethylsulfoniumbromide, an azole derivative, an amine, urea, mercaptobenzothiazole (MET), benzotriazole, tolyltriazole, an aldehyde, a heterocyclic nitrogen compound, a sulfur-containing compound, an acetylenic compound, ascorbic acid, succinic acid, tryptamine, caffeine, a heterocyclic acid, a phosphosilicate compound (such as that within the HALOX® 750 corrosion inhibitor), or a phenolic acid compound (such as HALOX® RC-980). Where the solution further comprises two corrosion inhibitors that are not from plants, the corrosion inhibitors may have mass ratios of 10:1-1:10, preferably 5:1-1:5, more preferably 2:1-1:2 with each other.

In an alternative embodiment, a compound of the solution may decrease a rate of corrosion by reacting with and/or neutralizing a corrosive agent, rather than by adsorbing to the surface of the steel.

Generally, corrosive agents are present as aqueous solutions, and may occur naturally through seawater, groundwater, mist, rainfall, and other precipitation. Corrosive agents may also result from air pollution (such as acid rain), water pollution, seepage, or industrial processes, such as meta dust. In one embodiment, the corrosive agent is an aqueous solution comprising a salt or an inorganic acid. In this embodiment, where the corrosive agent is present as an aqueous solution of a salt, the salt may be a chloride salt, a carbonate salt, a bicarbonate salt, and/or a sulfate salt. Additionally, other salts, such as those listed previously for the extraction medium, may be corrosive agents. Where the corrosive agent is present as an aqueous solution comprising an inorganic acid, the inorganic acid may be nitric acid, hydrochloric acid, hydrofluoric acid, sulfuric acid, and/or perchloric acid. Additionally, other organic and inorganic acids, and bases, as listed earlier may be corrosive agents. Corrosive agents may also require other compounds to be present, such as oxygen, in order to corrode a material. An aqueous solution may contain a corrosive agent at low amounts, such as 0.001-1 wt %, preferably 0.01-0.1 wt % of the total aqueous solution weight. Alternatively, an aqueous solution comprising a corrosive agent may be drying or evaporating on the surface of the steel, leading to higher concentrations of the corrosive agent. In this case the corrosive agent may be present at 80-99.9 wt %, or 90-95 wt % of the aqueous solution weight. In other embodiments, the corrosive agent may be present in the aqueous solution at a more moderate weight percentage, such as 1-30 wt %, preferably 2-20 wt %.

The corrosion of a metal or metal alloy, including steel, often occurs through electrochemical oxidation. To test the efficiency of corrosion inhibitors for steel in the presence of a corrosive agent, an electrochemical cell may be constructed using the steel as an electrode. Then, electrochemical parameters such as current density, cathodic and anodic Tafel slopes, charge transfer resistance, and double layer capacitance may be measured by applying different voltages and/or currents. Inhibition efficiency and surface coverage of a corrosion inhibitor may be derived from those measurements. The steel may be treated with a corrosion inhibitor beforehand or may be simultaneously exposed to both a corrosion inhibitor and corrosive agent in the electrochemical cell. A piece of steel may be allowed to equilibrate with a corrosion inhibitor and corrosive agent for 15 min-6 h, preferably 30 min-2 h before taking electrochemical measurements.

In one embodiment of the method, the treated steel is an electrode with a corrosion current density of 0.001-0.05 $mA/cm^2$, preferably 0.005-0.05 $mA/cm^2$, more preferably 0.01-0.05 $mA/cm^2$ in the presence of 0.1-1 M, preferably 0.2-0.8 M, more preferably 0.4-0.6 M inorganic acid at 20-30° C., preferably 22-27° C. In this embodiment, the inorganic acid is the corrosive agent, and may be any of those listed previously, though in a preferred embodiment, the inorganic acid is hydrochloric acid. The corrosion potential may be −510--490 mV, preferably −500--485 mV. The treated steel may have an electrode surface area of 0.5-2 $cm^2$, preferably 0.8-1.2 $cm^2$. The treated steel may form the working electrode in an electrochemical cell that also has a platinum electrode with a surface area of 0.05-0.5 $cm^2$, preferably 0.2-0.4 $cm^2$ as a counter electrode and a saturated calomel electrode as a reference electrode. In this embodiment, the steel may be treated first, and then placed in contact with the inorganic acid. However, in another embodiment, the steel becomes treated steel by placing it in a solution comprising 20-300 ppm, preferably 60-80 ppm of the citrus leaf extract, 20-450 ppm of the second leaf extract, and the inorganic acid. This treated steel in the solution may form part of the electrochemical cell for electrochemical measurements.

In one embodiment of the method, a corrosion of the treated steel in the presence of a corrosive agent is inhibited 85-100%, preferably 87-98%, more preferably 90-95% more than a control piece of steel contacted with the citrus leaf extract and no second leaf extract in the presence of the corrosive agent. This inhibition may be measured by an electrochemical cell as mentioned previously. The treated steel may be in contact with a solution comprising 20-300 ppm, preferably 60-80 ppm of the citrus leaf extract, 20-450 ppm, preferably 200-400 ppm of the second leaf extract, and 0.1-1 M, preferably 0.3-0.8 M inorganic acid. The control piece of steel may be in contact with a solution comprising 20-300 ppm, preferably 60-80 ppm of the citrus leaf extract, and 0.1-1 M inorganic acid. Preferably the two steels have the same shape and size, and the solutions have the same initial compositions except for the presence of the second leaf extract. The percentage difference of corrosion inhibition as mentioned above may be determined by comparing the corrosion current densities of the two electrochemical cells. The presence of the second leaf extract may lead to a lower current density due to its adsorption on the steel, which inhibits its corrosion.

In one alternative embodiment, a solution containing 20-450 ppm, preferably 200-450 ppm, more preferably 300-450 ppm of a second leaf extract and no citrus leaf extract may be applied to a surface of a steel to inhibit corrosion. In a further embodiment, this second leaf extract may be an aqueous leaf extract from a saffron plant, an almond plant, a *Psidium guajava* plant, and/or an *Origanum majorana* plant. In a preferred embodiment, the second leaf extract may be an aqueous leaf extract from an *Origanum majorana* plant and may be present in the solution at a 340-370 ppm concentration. The solution may comprise other compounds and may be applied in a manner as mentioned previously.

According to a second aspect, the present disclosure relates to a method of cleaning steel. This involves the step of contacting a surface of a steel with a solution comprising 20-300 ppm of an aqueous extract from the leaf of a *Citrus x limon* plant to form a cleaned steel. In this embodiment, the solution may be made according to previously mentioned methods with the exception that there is no other plant extract, second leaf extract, or other corrosion inhibitor present in the solution. However, in one embodiment, the solution may further comprise another additive such as an acid, a stabilizing agent, or a carrier agent such as those mentioned previously. The steel may be any of the previously mentioned steels, and preferably the steel may have an impurity on its surface, such as an oxide layer or rust, a stain, residue of an organic substance, a dye, or some other unwanted compound. The solution may be applied by any of the previously mentioned methods, and may remove the impurity, cleaning the steel. In one embodiment, the solution may react and dissolve the impurity in order to clean the steel. In another embodiment, the solution may corrode the surface of the steel to the extent that the impurity on the surface is removed, and this process may be known as "pickling." In one embodiment, the steel may be submerged in the solution until the impurity is removed. Alternatively, the solution may be applied and rubbed on the steel until the impurity is visibly removed. Once cleaned, the steel may be rinsed with water and dried. It may then be coated with the solution of the first aspect, or some other corrosion inhibitor, to passivate or protect the surface of the steel. In other embodiments, the method may be adapted to other metals, such as pure iron, silver, aluminum, and copper.

In one embodiment, the citrus leaf extract, the second leaf extract, or both may be used for industrial pickling, descaling, or passivation of steel or other metals. Pickling, as mentioned above, involves contacting a metal with a solution in order to remove a thin layer of the surface. A metal may be pickled in order to remove impurities, such as a welding-tinted layers, stains, rust, and scale. Pickling may also remove chromium-depleted layers, which are more prone to corrosion if left untreated. Pickling typically require exposure to a mixture of nitric acid and hydrofluoric acid. Descaling is a process to remove a visibly thick layer of oxide from the metal surface. It may involve submerging the steel in a similar pickling solution and also mill descaling or polishing to mechanically separate the oxide layer. After removing the thick oxide layer, the metal may be pickled as mentioned previously to further remove impurities. Preferably the solution of the citrus leaf extract, without the second leaf extract, may be used to pickle or descale steel.

Steel passivation involves the formation of a passive film on the steel surface to protect against corrosion. Passivation may occur naturally, where an oxide layer naturally forms on the surface of steel. In other cases, the formation of an oxide layer may be assisted by acid treatment, such as with a solution of nitric acid, nitric acid with sodium dichromate, or citric acid. As mentioned above, the citrus leaf extract, the second leaf extract, or both may be used for steel passivation. In one embodiment, the method of inhibiting corrosion of steel, as mentioned in the first aspect of the disclosure, is essentially equivalent to a method of steel passivation, if compounds of the citrus leaf extract or second leaf extract are considered to form a passive layer. It follows that "treated steel" may be essentially equivalent to "passivated steel." Where steel may be passivated, the steel may be cleaned, pickled, or descaled beforehand, even if impurities are not present or visible. Likewise, where steel is cleaned, pickled, or descaled, the steel may be passivated soon afterwards to further protect the surface against corrosion and staining.

The examples below are intended to further illustrate protocols for preparing, characterizing the natural leaves extract, and uses thereof, and are not intended to limit the scope of the claims. See M. A. Al-Khaldi, *Asian J. Chem,* 11, 2532 (2016), incorporated herein by reference in its entirety.

EXAMPLE 1

Experimental

Test Specimen

The working electrode is a steel specimen composed of (wt %): C 0.2%, Mn 0.6%, P 0.04%, Si 0.003%, and Fe 99.157%. The metal specimens were polished with successive grades of emery papers (600 and 1200), degreased with acetone and then rinsed with running distilled water before immersion in the test solution.

Solution Preparation Method

Analytical grade 37% HCl was used in the preparation of 0.5 M HCl solution via dilution with doubly-distilled water. 3.0 g of lemon leaves were soaked in 20 mL of doubly-distilled water at 60° C. for 24 h, blended, filtrated, and then added in different amounts to 0.5 M HCl to get appropriate solutions of different lemon extract concentrations (37.5, 75, 150, and 250 ppm). Different amounts of different leaves extracts (saffron, almonds, guava (*Psidium guajava*) leaves, and *Origanum majorana*) were added to a solution of 75 ppm of lemon leaves extract and 0.5 M HCl.

Employed Techniques

The electrochemical perpetuation is carried out in a conventional three-electrode glass cell. The working electrode was a steel disc having a geometric area of 1 $cm^2$. The reference electrode is a saturated calomel electrode (SCE) and the counter electrode is a sheet of platinum having an area of 0.25 $cm^2$. The electrochemical behavior was studied using an ACM-instrument-Gill AC potentiostat controlled with a PC at a scan rate of 200 mV $min^{-1}$ in between −800 mV and 400 mV. Before each measurement, the specimens were immersed for 1 h to attain the equilibrium potential. The response of the system (steel in absence and presence of the plant extract) was analyzed, and respective kinetic parameters such as corrosion potential ($E_{corr}$), cathodic and anodic Tafel slopes ($b_c$, $b_a$), and corrosion current density ($I_{corr}$) were obtained. The inhibition efficiency (IE, %) was calculated using the following equation:

$$IE\ (\%) = \frac{I^{o}_{corr} - I_{corr}}{I^{o}_{corr}} \times 100 \quad (1)$$

where $I^{o}_{corr}$ and $I_{corr}$ are the corrosion current densities in the absence and presence of plant extracts, respectively. See E. Bayol, et al., *Mater. Chem. Phys.,* 104, 74 (2007), and L. Tang, et al., *Corros. Sci.,* 45, 2251 (2003), each incorporated herein by reference in its entirety.

The impedance measurements (EIS) were carried out in the frequency range of 0.01-30 Hz at the open circuit potential (OCP). The spectrum, obtained by EIS, was investigated for charge-transfer resistance ($R_{ct}$), whose value is a measure of electron transfer across the surface and can be calculated from the difference in impedance at lower and higher frequencies. The double layer capacitance ($C_{dl}$) was obtained at the frequency $f_{max}$, at which the imaginary component of the impedance is maximal ($-Z_{max}$), using the following equation:

$$C_{dl} = \frac{1}{2\pi f_{max} R_{ct}} \quad (2)$$

The inhibition efficiency percentage (IE, %) is calculated from the following equation:

$$IE\ (\%) = \frac{R_{ct(inh)} - R_{ct(acid)}}{R_{ct(inh)}} \times 100 \quad (3)$$

where $R_{ct(inh)}$ and $R_{ct(acid)}$ are the charge-transfer resistance values in the presence and absence of inhibitor, respectively.

EXAMPLE 2

Results and Discussion

Potentiodynamic Polarization Curves

The potentiodynamic polarization curves for steel in 0.5 M HCl with different concentrations of lemon leaves extracts at 25° C. and in 75 ppm of lemon leaves extract with different concentrations of saffron, almonds, guava leaves, and *Origanum majorana* extracts are shown in FIGS. 1, 2, 3, 4, and 5, respectively. The respective kinetic parameters derived from potentiodynamic polarization curves such as corrosion potential ($E_{corr}$), cathodic and anodic Tafel slopes ($b_c$, $b_a$), and corrosion current density ($I_{corr}$) are given in Tables 1 and 2.

FIG. 1 and Table 1 reveal that the polarization curves are shifted towards more negative potentials and greater current densities with the addition of lemon leaves extracts. This behavior indicates that lemon leaves extract acts as corrosive media for the steel. On the other hand, polarization curves in FIGS. 2-5 shifted towards lower current density while increasing the concentration of each saffron, almonds, guava leaves, and *Origanum majorana* extracts. This indicates that their compounds are adsorbed on the metal surface and hence inhibition occurs.

TABLE 1

Electrochemical corrosion parameters for steel in 0.5M HCl containing different concentrations of lemon leaves extracts at 25° C.

| C ppm of lemon leaves extract + (0.5M) HCl | $E_{corr}$ (mV) | $I_{corr}$ (mA/cm$^2$) | $b_c$ (mV) | $b_a$ (mV) |
|---|---|---|---|---|
| 0 | −399.6 | 0.055 | 111.7 | 68.3 |
| 37.5 | −452.8 | 0.211 | 85.5 | 91.1 |
| 75 | −465.4 | 0.580 | 56.06 | 56.5 |
| 150 | −469.9 | 0.720 | 55.37 | 86.8 |
| 250 | −452.0 | 0.809 | 91.91 | 106.2 |

TABLE 2

Electrochemical corrosion parameters for steel in 0.5M HCl containing 75 ppm of lemon leaves extract and different concentrations of inhibitor extract at 25° C.

| Inhibitor | $C_{ppm}$ | $E_{corr}$ (mV) | $I_{corr}$ (mA/cm$^2$) | $b_c$ (mV) | $b_a$ (mV) | IE (%) |
|---|---|---|---|---|---|---|
| Blank | — | −492.38 | 0.58 | 56.1 | 56.5 | — |
| Saffron | 37.5 | −487.8 | 0.49 | 64.3 | 89.9 | 15.5 |
| | 75 | −457.6 | 0.39 | 95.9 | 132.8 | 32.8 |
| | 150 | −490.6 | 0.36 | 61.5 | 80.2 | 37.9 |
| | 250 | −494.6 | 0.34 | 57.4 | 89.2 | 41.4 |
| Almonds | 37.5 | −521.8 | 0.10 | 116.5 | 117.1 | 82.0 |
| | 75 | −516.9 | 0.069 | 92.8 | 106.3 | 88.1 |
| | 150 | −517.2 | 0.05 | 90.5 | 120.9 | 91.0 |
| | 250 | −519.5 | 0.065 | 113.0 | 137.8 | 88.8 |
| Guava leaves | 37.5 | −519.5 | 0.123 | 123 | 161 | 79.0 |
| | 75 | −519.4 | 0.106 | 111.8 | 150 | 82.0 |
| | 150 | −519.7 | 0.07 | 93 | 104 | 88.0 |
| *Origanum majorana* | 37.5 | −501.4 | 0.071 | 101.5 | 116.8 | 87.7 |
| | 75 | −499.08 | 0.069 | 105.7 | 123.5 | 88.1 |
| | 150 | −503.6 | 0.061 | 92.5 | 117.9 | 89.4 |
| | 250 | −499 | 0.046 | 92.4 | 102.6 | 92.0 |
| | 350 | −498 | 0.040 | 86.5 | 10.8 | 93.0 |

Table 2 suggests that both the anodic and cathodic Tafel constants are affected by addition of saffron, almonds, guava leaves, and *Origanum majorana* extracts. This indicates that they act as a mixed inhibitor. This behavior reflects that both anodic metal dissolution of iron and cathodic hydrogen evolution reaction were inhibited after the addition of inhibitors. Both processes hindered the acid attack on the steel electrode due to the adsorption of the organic compounds present in the extracts at the active sites of the electrode surface. It is noticed from Table 2 that the inhibition efficiency calculated from Eqn. 1 increases with increasing the concentration of inhibitor extracts, but for almond at concentrations more than 150 ppm, the inhibition of steel corrosion decreases. This would suggest that protonated species may take part in catalyzing the hydrogen evolution reaction. The inhibition efficiency data showed that the *Origanum majorana* extract has greater interaction with steel compared to other additives as the following order:

*Origanum majorana*>Guava Leaves≈Almonds>Saffron

The order reflects the important role played by the molecular size and the substituent group of inhibitors molecules, as well as the type of the functional adsorption atom in the inhibition processes. See M. Abdallah, I. et al., *Chem. Technol. Fuels Oils,* 48, 234 (2012); S. Noyel Victoria et al., *Int. J. Electrochem. Sci.,* 10, 2220 (2015); T. Y. Soror, *Eur. Chem. Bull.,* 2, 191 (2013); and R. Oukhrib, et al., *Chem. Sci. Rev. Lett.,* 4, 241 (2015), each incorporated herein by reference in its entirety.

Electrochemical Impedance Measurements (EIS):

Impedance spectra for steel in 0.5 M HCl containing different concentrations of lemon leaves extracts and 75 ppm of lemon leaves extract with different concentration of each saffron, almonds, guava leaves, and *Origanum majorana* extracts are given in FIGS. 6, 7, 8, 9, and 10, respectively. The impedance diagram (Nyquist) contains a depressed semicircle with the center under the real axis, such behavior is characteristic for solid electrodes, often referred to as frequency dispersion, and has been attributed to roughness and inhomogeneities of the solid surface. The plots indicate that the process occurs under activation control. Tables 3 and 4 collect various parameters such as charge transfer resistance ($R_{ct}$) and double layer capacitance ($C_{dl}$) using Eqn. 2. The inhibition efficiency percentage (% IE) from the charge-transfer resistance is calculated from Eqn. 3. It is clear from Table 3 that the charge-transfer resistance $R_{ct}$ is inversely proportional to both corrosion rate $I_{corr}$ and the pseudo capacity $C_{dl}$ as the lemon leaves extracts concentration is increased. This may indicate that the lemon leaves compounds may take part in catalyzing the hydrogen evolution reaction. On the other hand, adding saffron, almonds, guava leaves, and *Origanum majorana* extracts to the lemon leaves extract solution increases $R_{ct}$ and decreases $C_{dl}$ because those plant extracts inhibit the corrosion rate of steel by an adsorption mechanism (Table 4). These results suggested that the formed inhibitive film was strengthened as the concentration was increased, and these results confirm the results obtained above from the polarization measurements. See S. T. Zhang, et al., *Appl. Surf. Sci.,* 255, 6757 (2009), incorporated herein by reference in its entirety.

TABLE 3

Electrochemical impedance parameters for steel in 0.5M HCl containing different concentrations of lemon leaves extracts at 25° C.

| | Concentration (ppm) of lemon leaves extract in 0.5M HCl | | | | |
|---|---|---|---|---|---|
| | 0 | 37.5 | 75 | 150 | 250 |
| $R_{ct}$ ($\Omega$ cm$^2$) | $2.3 \times 10^2$ | $1.7 \times 10^2$ | $1.1 \times 10^2$ | $0.81 \times 10^2$ | $0.80 \times 10^2$ |
| $C_{dl}$ (μF/Cm$^2$) | $1.8 \times 10^{-3}$ | $0.8 \times 10^{-3}$ | $2.2 \times 10^{-3}$ | $2.3 \times 10^{-3}$ | $2.69 \times 10^{-3}$ |

TABLE 4

Electrochemical impedance parameters for steel in 0.5M HCl containing 75 ppm of lemon leaves extract and different concentrations of inhibitor extract at 25° C.

| Inhibitor | ppm | $R_{ct}$ ($\Omega$cm$^2$) | $C_{dl}$ (μF/cm$^2$) | θ | IE (%) |
|---|---|---|---|---|---|
| Blank | | $1.2 \times 10^2$ | 0.72 | | |
| Saffron | 37.5 | $1.46 \times 10^2$ | $3.05 \times 10^{-3}$ | 0.178 | 17.8 |
| | 75 | $1.83 \times 10^2$ | $2.59 \times 10^{-3}$ | 0.340 | 34.0 |
| | 150 | $2.2 \times 10^2$ | $2.1 \times 10^{-3}$ | 0.454 | 45.4 |
| | 250 | $2.55 \times 10^2$ | $2.4 \times 10^{-3}$ | 0.530 | 53.0 |
| Almonds | 37.5 | $2.22 \times 10^3$ | $1.42 \times 10^{-4}$ | 0.945 | 94.5 |
| | 75 | $2.5 \times 10^3$ | $1.38 \times 10^{-4}$ | 0.952 | 95.2 |
| | 150 | $2.9 \times 10^3$ | $1.19 \times 10^{-4}$ | 0.958 | 95.8 |
| | 250 | $2.4 \times 10^3$ | $1.28 \times 10^{-4}$ | 0.950 | 95.0 |
| Guava leaves | 37.5 | $2.06 \times 10^3$ | $1.19 \times 10^{-4}$ | 0.942 | 94.2 |
| | 75 | $2.21 \times 10^3$ | $1.20 \times 10^{-4}$ | 0.945 | 94.5 |
| | 150 | $2.47 \times 10^3$ | $1.04 \times 10^{-4}$ | 0.951 | 95.1 |

TABLE 4-continued

Electrochemical impedance parameters for steel in 0.5M HCl containing 75 ppm of lemon leaves extract and different concentrations of inhibitor extract at 25° C.

| Inhibitor | ppm | $R_{ct}$ ($\Omega$cm$^2$) | $C_{dl}$ (μF/cm$^2$) | θ | IE (%) |
|---|---|---|---|---|---|
| *Origanum majorana* | 37.5 | $2.14 \times 10^3$ | $1.28 \times 10^{-4}$ | 0.943 | 94.3 |
| | 75 | $2.35 \times 10^3$ | $1.16 \times 10^{-4}$ | 0.948 | 94.8 |
| | 150 | $2.52 \times 10^3$ | $1.13 \times 10^{-4}$ | 0.952 | 95.2 |
| | 250 | $2.57 \times 10^3$ | $1.10 \times 10^{-3}$ | 0.953 | 95.3 |
| | 350 | $2.60 \times 10^3$ | $1.11 \times 10^{-3}$ | 0.954 | 95.4 |

Adsorption Isotherm

The adsorption mode of inhibitors on the steel surface in the given medium must be defined by the relationship between concentration of inhibitor extracts (C) and fraction of steel surface coverage (θ) by the adsorbed compound. The degree of surface coverage, (θ), at different concentrations of inhibitor extract (saffron, almonds, guava leaves, and *Origanum majorana*) $C_{inh}$ in 0.5 M HCl containing 75 ppm of lemon leaves extract was evaluated from electrochemical impedance measurement (Table 4) using the following equation:

$$\theta = \frac{R_{ct(inh)} - R_{ct(acid)}}{R_{ct(inh)}} \tag{4}$$

The data was tested graphically, the best fit was obtained for the relation between $C_{inh}/\theta$ and $C_{inh}$ which are represented in FIGS. 11A-11D. The data indicate that the adsorption process follows a Langmuir adsorption isotherm. The plot is linear with a high correlation coefficient of 0.9. The Langmuir adsorption isotherm can be represented using the following equation:

$$\frac{C_{inh}}{\theta} = \frac{1}{K_{ads}} + C_{inh} \tag{5}$$

where $K_{ads}$ is the equilibrium constant of the adsorption process. See S. M. A. Hosseini et al., *Corros. Sci.,* 51, 728 (2009), incorporated herein by reference in its entirety. The free energy of adsorption $\Delta G_{ads}$, can be calculated by Eqn. 6. The numeral of 55.5 is the molar concentration of the solution in water:

$$\ln K_{ads} = \ln\frac{1}{55.5} - \frac{\Delta G_{ads}}{RT} \tag{6}$$

The values for adsorption of saffron, almonds, guava leaves, and *Origanum majorana* extracts were found to be −16.03, −19.04, −19.02, and −16.51 kJ mol$^{-1}$, respectively. The negative value suggests that the adsorption of inhibitor components on the steel surface is a spontaneous process. Literature survey reveals that the values around −20 kJ mol$^{-1}$ or lower are consistent with the electrostatic interaction between the charged molecules and the charged metal (physical adsorption) while those negative than 40 kJ mol$^{-1}$ involve sharing or transfer of electrons from the inhibitor molecules to the metal surface to form a co-ordinate type of bond (chemisorption). See J. C. da Rocha et al., *Corros. Sci.,* 52, 2341 (2010); M. H. Hussin et al., *Mater. Chem. Phys.,*

125, 461 (2011); S. T. Zhang, et al., *Appl. Surf. Sci.,* 255, 6757 (2009); and S. M. A. Hosseini et al., *Corros. Sci.,* 51, 728 (2009), each incorporated herein by reference in its entirety. In this study, the values of $\Delta G_{ads}$ are between −16.03 and −19.04, which suggests that the adsorption mechanism of inhibitors on steel is physical adsorption.

Effect of Temperature

Figure 12:
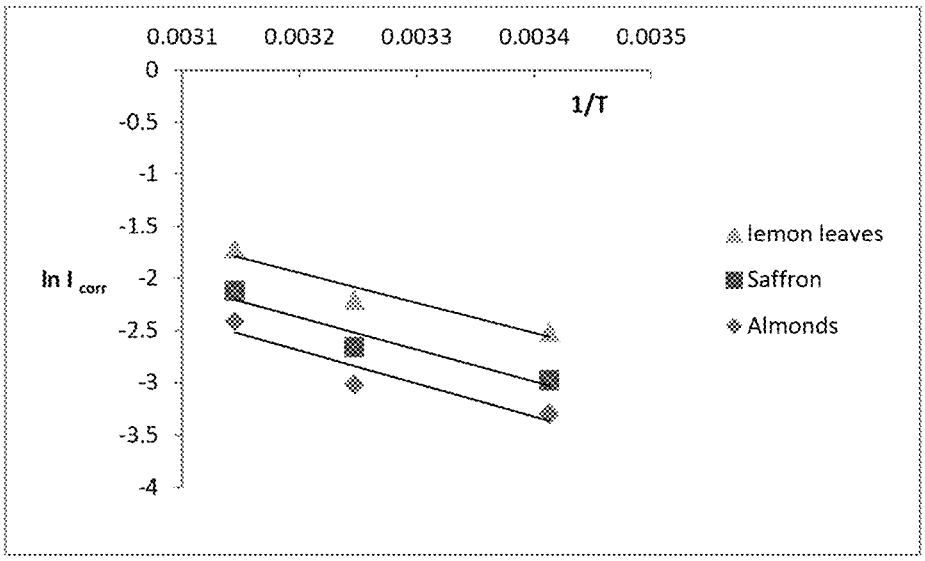
FIG. 12 is a plot showing Arrhenius slopes calculated from the corrosion current density of steel in 0.5 M HCl with 37.5 ppm lemon leaves extract without a second leaf extract, with 20 ppm saffron leaves extract, or with 20 ppm almond leaves extract.

The effect of temperature on inhibition efficiencies of saffron and almonds extracts was studied in the temperature range 20-45° C. in 0.5 M HCl with lemon leaves extract using polarization measurements (Table 5). Inspection of Table 5 reveals that the corrosion rates of steel in lemon leaves extract and lemon leaves extract with saffron or almonds extracts increased as the temperature was increased but is more pronounced for lemon leaves extract solution, the values of inhibition efficiency decreases slightly with an increase in temperature. The apparent activation energies $E_a$ of the corrosion process in the absence and presence of inhibitor were evaluated from the Arrhenius equation:

$$k = A.\exp\left(-\frac{E_a}{RT}\right) \tag{7}$$

where $E_a$ is the activation energy, A is the frequency factor, T is the absolute temperature, R is the gas constant, and k is the rate constant, which is directly proportional to the corrosion current ($I_{corr}$). Values of $E_a$ for steel in lemon leaves extract and lemon leaves extract with saffron or almonds extracts were determined from the slope of ln $I_{corr}$ versus 1/T plots (FIG. 12). The values of activation energy are 23.7 kJ $mol^{-1}$, 25.4 kJ $mol^{-1}$, and 26.2 kJ $mol^{-1}$, respectively. The obtained results suggest that saffron and almonds extracts inhibit the corrosion reaction by increasing its activation energy. The higher activation energy value in the presence of almonds supports the results obtained from polarization measurements and EIS.

TABLE 5

Corrosion parameters obtained from polarization curves and EIS of steel in lemon leaves extract (37.5 ppm) and lemon leaves extract (37.5 ppm) with saffron (20 ppm) or almonds (20 ppm) in 0.5M HCl at different temperatures.

| T (K) | Solution | $E_{corr}$ (mV) | $I_{corr}$ (mA/cm$^2$) | $R_{ct}$ (Ω cm$^2$) | IE (%) |
|---|---|---|---|---|---|
| 293 | Lemon leaves | −526.2 | 0.081 | $2.01 \times 10^3$ | — |
| | Saffron + lemon leaves | −521.7 | 0.051 | $2.17 \times 10^3$ | 37.0 |
| | Almonds + lemon leaves | −521.53 | 0.037 | $2.25 \times 10^3$ | 54.3 |
| 308 | Lemon leaves | −526.3 | 0.11 | $1.07 \times 10^3$ | — |
| | Saffron + lemon leaves | −526.4 | 0.07 | $1.70 \times 10^3$ | 36.0 |
| | Almonds + lemon leaves | −519.4 | 0.049 | $1.80 \times 10^3$ | 54.0 |
| 318 | Lemon leaves | −455.2 | 0.18 | $0.17 \times 10^3$ | — |
| | Saffron + lemon leaves | −505.5 | 0.12 | $0.62 \times 10^3$ | 33.0 |
| | Almonds + lemon leaves | −507.7 | 0.09 | $0.78 \times 10^3$ | 50.0 |

In summary, the aqueous extract of lemon leaves acts as a corrosive media for the steel. Saffron, almonds, guava leaves and *Origanum majorana* extracts with lemon leaves extract act as good inhibitors against the corrosion of steel in 0.5 M HCl. The inhibition efficiency of the inhibitor increases as its concentration increases. The addition of saffron, almond, guava leaves, and *Origanum majorana* supported the corrosion inhibition action in acidic media with the following order of inhibition efficiency:

*Origanum majorana*>guava leaves≈almonds>saffron.

Aqueous extracts of saffron, almonds, guava leaves, and *Origanum majorana* act as a mixed inhibitor. The adsorption process of inhibitor extracts follows a Langmuir adsorption isotherm.

The invention claimed is:

1. A method of inhibiting corrosion of steel, comprising: contacting a surface of the steel with a solution comprising 20-300 ppm of a citrus leaf extract and 20-450 ppm of a second leaf extract to form a treated steel.

2. The method of claim 1, wherein the citrus leaf extract is an aqueous extract from the leaf of a *Citrus x limon* plant.

3. The method of claim 1, wherein the second leaf extract is an aqueous leaf extract from a saffron plant, an almond plant, a *Psidium guajava* plant, and/or an *Origanum majorana* plant.

4. The method of claim 3, wherein the solution comprises 50-100 ppm of the citrus leaf extract and 300-450 ppm of the aqueous leaf extract from an *Origanum majorana* plant.

5. The method of claim 1, wherein the solution further comprises a carrier agent or a stabilizing agent.

6. The method of claim 5, wherein the carrier agent is present, and wherein the carrier agent is at least one selected from the group consisting of methanol, ethanol, isopropanol, ethylene glycol, propylene glycol, dimethylformamide, dimethyl sulfoxide, N-methyl pyrrolidone, propylene glycol methyl ether, 2-butoxyethanol, and a hydrofluoroalkane.

7. The method of claim 5, wherein the stabilizing agent is present, and wherein the stabilizing agent is at least one selected from the group consisting of acetic acid, a citrate buffer, a borate buffer, a phosphate buffer, benzalkonium chloride, butylated hydroxytoluene, butylated hydroxyanisole, EDTA, and EGTA.

8. The method of claim 1, wherein the citrus leaf extract is made by heating a citrus leaf in water with a mass ratio of the citrus leaf to water of 0.01:1-1:1, and wherein the second leaf extract is made by heating a second leaf in water with a mass ratio of the second leaf to water of 0.01:1-1:1.

9. The method of claim 8, wherein the citrus leaf and the second leaf are heated in water at 50-125° C. for 0.25-48 h.

10. The method of claim 9, wherein the citrus leaf, the second leaf, or both are crushed, blended, or cut.

11. The method of claim 1, wherein the solution is formed by reconstituting a dried citrus leaf extract, a dried second leaf extract, or both in water.

12. The method of claim 1, wherein the citrus leaf extract, the second leaf extract, or both is adsorbed onto a 0.90-0.97 surface area fraction of the steel.

13. The method of claim 1, wherein a corrosion of the treated steel in the presence of a corrosive agent is inhibited 85-100% more than steel contacted with the citrus leaf extract and no second leaf extract in the presence of the corrosive agent.

14. The method of claim 13, wherein the corrosive agent is an aqueous solution comprising a salt or an inorganic acid.

15. The method of claim 14, wherein the inorganic acid is present, and wherein the inorganic acid is at least one selected from the group consisting of nitric acid, hydrochloric acid, hydrofluoric acid, sulfuric acid, and perchloric acid.

16. The method of claim 14, wherein the salt is present, and wherein the salt is at least one selected from the group consisting of a chloride salt, a carbonate salt, a bicarbonate salt, and a sulfate salt.

17. The method of claim 1, wherein the steel comprises 0.05-1.0 wt % carbon relative to a total weight of the steel.

18. The method of claim 1, wherein the contacting is done by spraying, submerging, painting, or spin coating.

19. The method of claim 1, wherein the treated steel is an electrode with a corrosion current density of 0.001-0.05 $mA/cm^2$ in the presence of 0.1-1 M inorganic acid at 20-30° C.

20. A method of cleaning steel, comprising:

contacting a surface of a steel with a solution comprising 20-300 ppm of an aqueous extract from the leaf of a *Citrus x limon* plant to form a cleaned steel.

* * * * *